US012075835B2

(12) United States Patent
Austin et al.

(10) Patent No.: US 12,075,835 B2
(45) Date of Patent: Sep. 3, 2024

(54) AEROSOL DELIVERY DEVICE WITH SUPPORT FOR MAINTAINING POSITION OF AEROSOL GENERATOR PORTION

(71) Applicant: Imperial Tobacco Limited

(72) Inventors: Andrew Austin, Liverpool (GB); Tamas Sajtos, Liverpool (GB); Andrew Tyler, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 560 days.

(21) Appl. No.: 17/211,422

(22) Filed: Mar. 24, 2021

(65) Prior Publication Data

US 2021/0204606 A1 Jul. 8, 2021

Related U.S. Application Data

(63) Continuation of application No. PCT/EP2019/075491, filed on Sep. 23, 2019, and a
(Continued)

(30) Foreign Application Priority Data

Sep. 24, 2018 (GB) ..... 1815463
Sep. 24, 2018 (GB) ..... 1815464
(Continued)

(51) Int. Cl.
*A24F 40/485* (2020.01)
*A24F 7/00* (2006.01)
(Continued)

(52) U.S. Cl.
CPC ..... *A24F 40/485* (2020.01); *A24F 7/00* (2013.01); *A24F 40/10* (2020.01); *A24F 40/30* (2020.01);
(Continued)

(58) Field of Classification Search
CPC ..... A24F 40/485; A24F 7/00; A24F 40/10; A24F 40/30; A24F 40/42; A24F 40/44;
(Continued)

(56) References Cited

U.S. PATENT DOCUMENTS 5,331,981 A 7/1994 Tamaoki et al.
6,155,268 A 12/2000 Takeuchi
(Continued)

FOREIGN PATENT DOCUMENTS

CA 2814977 A1 5/2012
CN 203194540 U 9/2013
(Continued)

OTHER PUBLICATIONS

International Search Report and Written Opinion (PCT/EP2019/075465); Dec. 2, 2019; 8 pgs.
(Continued)

*Primary Examiner* — Justin M Kratt
(74) *Attorney, Agent, or Firm* — DUNLAP CODDING, P.C.

(57) ABSTRACT

An aerosol delivery device comprises: an aerosol generator portion configured to receive a first aerosol precursor; an air flow passage configured to direct air past the aerosol generator portion to pick up the first aerosol precursor from the aerosol generator portion to form a first aerosol; and a support for maintaining the aerosol generator portion in a substantially central position in the air flow passage.

20 Claims, 11 Drawing Sheets

Related U.S. Application Data continuation of application No. PCT/EP2019/075493, filed on Sep. 23, 2019, and a continuation of application No. PCT/EP2019/075488, filed on Sep. 23, 2019, and a continuation of application No. PCT/EP2019/075478, filed on Sep. 23, 2019, and a continuation of application No. PCT/EP2019/075472, filed on Sep. 23, 2019, and a continuation of application No. PCT/EP2019/075465, filed on Sep. 23, 2019, and a continuation of application No. PCT/EP2019/075489, filed on Sep. 23, 2019, and a continuation of application No. PCT/EP2019/075487, filed on Sep. 23, 2019, and a continuation of application No. PCT/EP2019/075484, filed on Sep. 23, 2019, and a continuation of application No. PCT/EP2019/075481, filed on Sep. 23, 2019, and a continuation of application No. PCT/EP2019/075476, filed on Sep. 23, 2019, and a continuation of application No. PCT/EP2019/075474, filed on Sep. 23, 2019.

(30) Foreign Application Priority Data

| | | |
|---|---|---|
| Sep. 24, 2018 | (GB) | 1815465 |
| Sep. 24, 2018 | (GB) | 1815466 |
| Sep. 24, 2018 | (GB) | 1815467 |
| Sep. 24, 2018 | (GB) | 1815468 |
| Sep. 24, 2018 | (GB) | 1815469 |
| Sep. 24, 2018 | (GB) | 1815470 |
| Sep. 24, 2018 | (GB) | 1815471 |
| Sep. 24, 2018 | (GB) | 1815472 |
| Sep. 24, 2018 | (GB) | 1815474 |

(51) Int. Cl.

| | |
|---|---|
| ***A24F 40/10*** | (2020.01) |
| ***A24F 40/30*** | (2020.01) |
| ***A24F 40/42*** | (2020.01) |
| ***A24F 40/44*** | (2020.01) |
| ***A24F 40/46*** | (2020.01) |
| ***A24F 40/48*** | (2020.01) |
| ***A24F 40/70*** | (2020.01) |
| *A24F 40/40* | (2020.01) |

(52) U.S. Cl.

CPC ..... *A24F 40/42* (2020.01); *A24F 40/44* (2020.01); *A24F 40/46* (2020.01); *A24F 40/48* (2020.01); *A24F 40/70* (2020.01); *A24F 40/40* (2020.01)

(58) Field of Classification Search

CPC ..... A24F 40/46; A24F 40/48; A24F 40/70; A24F 40/40

See application file for complete search history.

(56) References Cited

U.S. PATENT DOCUMENTS

| | | | |
|---|---|---|---|
| 8,292,196 | B2 | 10/2012 | Varanasi et al. |
| 9,636,430 | B2 | 5/2017 | Gruenbacher et al. |
| 2006/0047368 | A1 | 3/2006 | Maharajh et al. |
| 2013/0008467 | A1 | 1/2013 | Vecellio-None et al. |
| 2013/0192615 | A1 | 8/2013 | Tucker et al. |
| 2014/0076310 | A1 | 3/2014 | Newton |
| 2014/0238422 | A1 | 8/2014 | Plunkett et al. |
| 2014/0261487 | A1 | 9/2014 | Chapman et al. |
| 2014/0261490 | A1 | 9/2014 | Kane |
| 2014/0334802 | A1 | 11/2014 | Dubief |
| 2015/0272218 | A1 | 10/2015 | Chen |
| 2015/0296884 | A1 | 10/2015 | Liu |
| 2015/0328415 | A1 | 11/2015 | Minskoff et al. |
| 2016/0150828 | A1 | 6/2016 | Goldstein et al. |
| 2016/0249684 | A1 | 9/2016 | Liu |
| 2016/0262456 | A1* | 9/2016 | Borkovec ..... H05B 1/0244 |
| 2016/0270446 | A1 | 9/2016 | Shenkal et al. |
| 2016/0309782 | A1 | 10/2016 | Malgat et al. |
| 2016/0331039 | A1 | 11/2016 | Thorens et al. |
| 2017/0048927 | A1 | 2/2017 | Murison et al. |
| 2017/0065000 | A1* | 3/2017 | Sears ..... A24F 40/40 |
| 2017/0072084 | A1 | 3/2017 | Gruenbacher et al. |
| 2017/0157341 | A1 | 6/2017 | Pandya et al. |
| 2017/0173278 | A1 | 6/2017 | Buchberger |
| 2017/0188635 | A1 | 7/2017 | Force et al. |
| 2017/0202266 | A1 | 7/2017 | Sur |
| 2017/0238596 | A1 | 8/2017 | Matsumoto et al. |
| 2017/0251722 | A1 | 9/2017 | Kobal et al. |
| 2017/0258143 | A1 | 9/2017 | Lederer |
| 2017/0273360 | A1 | 9/2017 | Brinkley et al. |
| 2017/0325505 | A1 | 11/2017 | Force et al. |
| 2017/0340003 | A1 | 11/2017 | Batista et al. |
| 2017/0360093 | A1 | 12/2017 | Fernando |
| 2017/0367411 | A1 | 12/2017 | Duc |
| 2018/0016040 | A1 | 1/2018 | Ewing et al. |
| 2018/0035713 | A1 | 2/2018 | Macko et al. |
| 2018/0177229 | A9* | 6/2018 | Reevell ..... H05B 1/0244 |
| 2018/0184719 | A1 | 7/2018 | Hon |
| 2018/0206556 | A1 | 7/2018 | Thorens et al. |
| 2018/0221605 | A1 | 8/2018 | Marks et al. |
| 2018/0264241 | A1 | 9/2018 | Plance et al. |
| 2018/0279681 | A1* | 10/2018 | Rojo-Calderon ..... A24D 1/20 |

FOREIGN PATENT DOCUMENTS

| | | | |
|---|---|---|---|
| CN | 203 388 268 | U | 1/2014 |
| EP | 0563120 | B1 | 1/1997 |
| EP | 2 319 334 | A1 | 5/2011 |
| EP | 2 712 511 | A1 | 4/2014 |
| EP | 3 066 940 | A1 | 9/2016 |
| EP | 3 066 941 | A1 | 9/2016 |
| EP | 3066940 | A1 | 9/2016 |
| EP | 3 127 441 | A1 | 2/2017 |
| EP | 3 135 138 | A1 | 3/2017 |
| EP | 3 162 227 | A1 | 5/2017 |
| EP | 3183979 | A1 | 6/2017 |
| EP | 3298911 | B1 | 7/2019 |
| EP | 3143884 | B1 | 1/2021 |
| GB | 1237223 | A | 6/1971 |
| GB | 2513637 | A | 5/2014 |
| GB | 2 513 637 | A | 11/2014 |
| GB | 2515562 | A | 12/2014 |
| GB | 2530980 | A | 4/2016 |
| GB | 2 548 647 | A | 9/2017 |
| KR | 20160110752 | A | 9/2016 |
| KR | 20180029239 | | 3/2018 |
| KR | 20190107913 | A | 9/2019 |
| WO | WO 2012/007130 | A1 | 1/2012 |
| WO | WO2013034458 | A1 | 3/2013 |
| WO | WO 2013/083635 | A1 | 6/2013 |
| WO | WO2014004648 | A1 | 1/2014 |
| WO | WO2014089174 | A2 | 6/2014 |
| WO | WO 2014/150131 | A1 | 9/2014 |
| WO | WO2016055653 | A1 | 4/2016 |
| WO | WO2016096497 | A1 | 6/2016 |
| WO | WO2016123764 | A1 | 8/2016 |
| WO | WO 2016/179376 | A1 | 11/2016 |
| WO | WO2017036828 | A1 | 3/2017 |
| WO | WO 2017/068099 | A1 | 4/2017 |
| WO | WO 2017/068101 | A1 | 4/2017 |
| WO | WO2017068101 | A1 | 4/2017 |
| WO | WO 2017/108268 | A1 | 6/2017 |
| WO | WO 2017/108721 | A1 | 6/2017 |
| WO | WO2017108268 | A1 | 6/2017 |
| WO | WO2017108721 | A1 | 6/2017 |
| WO | WO2017108991 | A1 | 6/2017 |
| WO | WO 2017/167511 | A1 | 10/2017 |
| WO | WO2017167511 | A1 | 10/2017 |
| WO | WO2017185051 | A1 | 10/2017 |
| WO | WO2017203407 | A1 | 11/2017 |
| WO | WO 2018/037245 | A1 | 3/2018 |

(56) References Cited

FOREIGN PATENT DOCUMENTS

| | | | |
|---|---|---|---|
| WO | WO2018069995 | A1 | 4/2018 |
| WO | WO 2019/162365 | A1 | 8/2019 |
| WO | WO 2019/162367 | A1 | 8/2019 |
| WO | WO 2019/162369 | A1 | 8/2019 |
| WO | WO 2019/162372 | A1 | 8/2019 |

OTHER PUBLICATIONS

International Search Report and Written Opinion (PCT/EP2019/075472); Jan. 3, 2019; 8 pgs.
International Search Report and Written Opinion (PCT/EP2019/075474); Dec. 13, 2019; 10 pgs.
International Search Report and Written Opinion (PCT/EP2019/075476); Nov. 22, 2019; 9 pgs.
International Search Report and Written Opinion (PCT/EP2019/075478); Mar. 23, 2020; 15 pgs.
International Search Report and Written Opinion (PCT/EP2019/075481); Feb. 5, 2020; 15 pgs.
International Search Report and Written Opinion (PCT/EP2019/075484); Dec. 19, 2019; 9 pgs.
International Search Report and Written Opinion (PCT/EP2019/075487); Jan. 13, 2020; 12 pgs.
International Search Report and Written Opinion (PCT/EP2019/075488); Jan. 14, 2020; 12 pgs.
International Search Report and Written Opinion (PCT/EP2019/075489); Jan. 7, 2020; 10 pgs.
International Search Report and Written Opinion (PCT/EP2019/075491); Jan. 22, 2020; 9 pgs.
International Search Report and Written Opinion (PCT/EP2019/075493); Jan. 3, 2020; 8 pgs.
UK Intellectual Property Office; Combined Search and Examination Report in GB1815463.3, filed Sep. 24, 2018, dated Mar. 12, 2019.
UK Intellectual Property Office; Combined Search and Examination Report in GB1815464.1, filed Sep. 24, 2018, dated Feb. 19, 2019.
UK Intellectual Property Office; Combined Search and Examination Report in GB1815465.8, filed Sep. 24, 2018, dated Feb. 19, 2019.
UK Intellectual Property Office; Combined Search and Examination Report in GB1815466.6, filed Sep. 24, 2018, dated Feb. 19, 2019.
UK Intellectual Property Office; Combined Search and Examination Report in GB1815467.4, filed Sep. 24, 2018, dated Mar. 26, 2019.
UK Intellectual Property Office; Combined Search and Examination Report in GB1815468.2, filed Sep. 24, 2018, dated Mar. 26, 2019.
UK Intellectual Property Office; Combined Search and Examination Report in GB1815469.0, filed Sep. 24, 2018, dated Mar. 26, 2019.
UK Intellectual Property Office; Combined Search and Examination Report in GB1815470.8, filed Sep. 24, 2018, dated Mar. 5, 2019.
UK Intellectual Property Office; Combined Search and Examination Report in GB1815471.6, filed Sep. 24, 2018, dated Mar. 26, 2019.
UK Intellectual Property Office; Combined Search and Examination Report in GB1815472.4, filed Sep. 24, 2018, dated Mar. 26, 2019.
UK Intellectual Property Office; Combined Search and Examination Report in GB1815473.2, filed Sep. 24, 2018, dated Feb. 19, 2019.
UK Intellectual Property Office; Combined Search and Examination Report in GB1815474.0, filed Sep. 24, 2018, dated Feb. 19, 2019.
European Patent Office, Examination Report dated Feb. 7, 2024 for European Application No. 19780178.0.

* cited by examiner

AEROSOL DELIVERY DEVICE WITH SUPPORT FOR MAINTAINING POSITION OF AEROSOL GENERATOR PORTION

CROSS REFERENCE TO RELATED APPLICATIONS/INCORPORATION BY REFERENCE STATEMENT

This application is a continuation of International Application No. PCT/EP19/075491, filed Sep. 23, 2019; which claims benefit of GB Application No. 1815463.3, filed Sep. 24, 2018. This application is also a continuation of International Application No. PCT/EP19/075474, filed Sep. 23, 2019, which claims benefit of GB Application No. 1815470.8, filed Sep. 24, 2018. This application is also a continuation of International Application No. PCT/EP19/075476, filed Sep. 23, 2019, which claims benefit of GB Application No. 1815474.0, filed Sep. 24, 2018. This Application is also a continuation of International Application No. PCT/EP19/075481, filed Sep. 23, 2019, which claims benefit of GB Application No. 1815469.0, filed Sep. 24, 2018. This application is also a continuation of International Application No. PCT/EP19/075484, filed Sep. 23, 2019, which claims benefit of GB Application No. 1815473.2, filed Sep. 24, 2018. This application is also a continuation of International Application No. PCT/EP19/075487, filed Sep. 23, 2019, which claims benefit of GB Application No. 1815472.4, filed Sep. 24, 2018. This application also is a continuation of International Application No. PCT/EP19/075489, filed Sep. 23, 2019, which claims benefit of GB Application No. 1815471.6, filed Sep. 24, 2018. This application is also a continuation of International Application No. PCT/EP19/075465, filed Sep. 23, 2019, which claims benefit of GB Application No. 1815468.2, filed Sep. 24, 2018. This application is also a continuation of International Application. No. PCT/EP19/075472, filed Sep. 23, 2019, which claims benefit of GB Application No. 1815467.4, filed Sep. 24, 2018. This application is also a continuation of International Application No. PCT/EP19/075478, filed Sep. 23, 2019, which claims benefit of GB Application No. 1815466.6, filed Sep. 24, 2018. This application is also a continuation of International Application No. PCT/EP19/075488, filed Sep. 23, 2019, which claims benefit of GB Application No. 1815465.8, filed Sep. 24, 2018. This application is also a continuation of International Application No. PCT/EP19/075493, filed Sep. 23, 2019, which claims benefit of GB Application No. 1815464.1, filed Sep. 24, 2018. The entire contents of each of the above-referenced patents and patent applications are hereby expressly incorporated herein by reference.

FIELD OF THE DISCLOSURE

The present disclosure relates to an aerosol delivery device and particularly, although not exclusively, to an aerosol delivery device comprising a support for maintaining an aerosol generator portion in a substantially central position.

BACKGROUND

A smoking-substitute device is an electronic device that permits the user to simulate the act of smoking by producing an aerosol mist or vapour that is drawn into the lungs through the mouth and then exhaled. The inhaled aerosol mist or vapour typically bears nicotine and/or other flavourings without the odour and health risks associated with traditional smoking and tobacco products. In use, the user experiences a similar satisfaction and physical sensation to those experienced from a traditional smoking or tobacco product, and exhales an aerosol mist or vapour of similar appearance to the smoke exhaled when using such traditional smoking or tobacco products.

One approach for a smoking substitute device is the so-called "vaping" approach, in which a vaporisable liquid, typically referred to (and referred to herein) as "e-liquid", is heated by a heating device to produce an aerosol vapour which is inhaled by a user. The e-liquid typically includes a base liquid as well as nicotine and/or flavourings. The resulting vapour therefore also typically contains nicotine and/or flavourings. The base liquid may include propylene glycol and/or vegetable glycerine.

A typical vaping smoking substitute device includes a mouthpiece, a power source (typically a battery), a tank for containing e-liquid, as well as a heating device. In use, electrical energy is supplied from the power source to the heating device, which heats the e-liquid to produce an aerosol (or "vapour") which is inhaled by a user through the mouthpiece.

Vaping smoking substitute devices can be configured in a variety of ways. For example, there are "closed system" vaping smoking substitute devices, which typically have a sealed tank and heating element. The tank is pre-filled with e liquid and is not intended to be refilled by an end user. One subset of closed system vaping smoking substitute devices include a main body which includes the power source, wherein the main body is configured to be physically and electrically coupled to a consumable including the tank and the heating element. The consumable may also be referred to as a cartomizer. In this way, when the tank of a consumable has been emptied, that consumable is disposed of. The main body can be reused by connecting it to a new, replacement, consumable. Another subset of closed system vaping smoking substitute devices are completely disposable, and intended for one-use only.

There are also "open system" vaping smoking substitute devices which typically have a tank that is configured to be refilled by a user. In this way the device can be used multiple times.

An example vaping smoking substitute device is the Myblu™ e-cigarette. The Myblu™ e cigarette is a closed system device which includes a main body and a consumable. The main body and consumable are physically and electrically coupled together by pushing the consumable into the main body. The main body includes a rechargeable battery. The consumable includes a mouthpiece, a sealed tank which contains e-liquid, as well as a heating device, which for this device is a heating filament coiled around a portion of a wick. The wick is partially immersed in the e-liquid, and conveys e-liquid from the tank to the heating filament. The device is activated when a microprocessor on board the main body detects a user inhaling through the mouthpiece. When the device is activated, electrical energy is supplied from the power source to the heating device, which heats e-liquid from the tank to produce a vapour which is inhaled by a user through the mouthpiece.

For a smoking substitute device it is desirable to deliver nicotine into the user's lungs, where it can be absorbed into the bloodstream. As explained above, in the so-called "vaping" approach, "e-liquid" is heated by a heating device to produce an aerosol vapour which is inhaled by a user. Many e-cigarettes also deliver flavour to the user, to enhance the experience. Flavour compounds are contained in the e-liquid that is heated. Heating of the flavour compounds may be undesirable as the flavour compounds are inhaled into the user's lungs. Toxicology restrictions are placed on the amount of flavour that can be contained in the e-liquid. This can result in some e-liquid flavours delivering a weak and underwhelming taste sensation to consumers in the pursuit of safety.

In aerosol delivery devices, it is desirable to avoid large liquid droplets reaching a user's mouth.

The present disclosure has been devised in light of the above considerations.

SUMMARY OF THE FIGURES

So that the invention may be understood, and so that further aspects and features thereof may be appreciated, embodiments illustrating the principles of the invention will now be discussed in further detail with reference to the accompanying figures, in which.

DETAILED DESCRIPTION OF THE INVENTION

Figure 1:
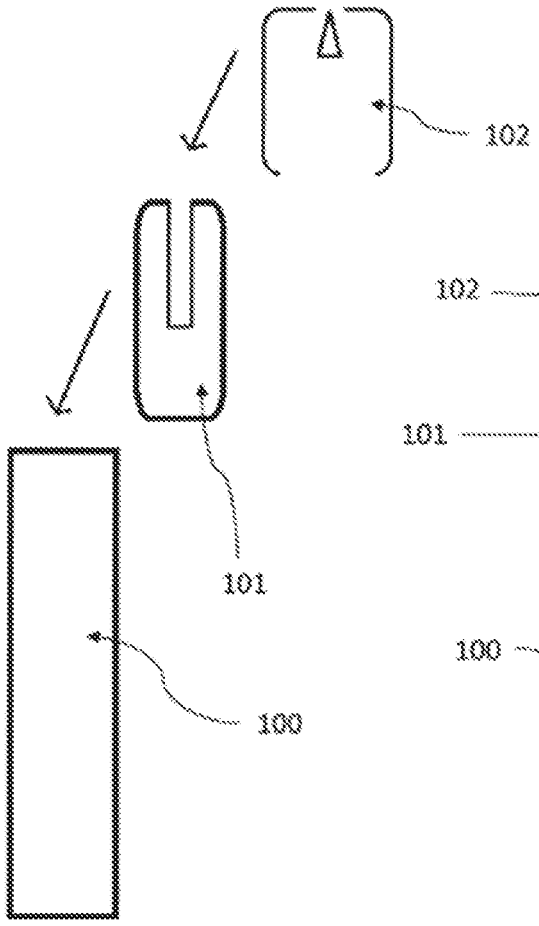
FIG. 1 shows a schematic drawing of a smoking substitute system.

Aspects and embodiments of the present invention will now be discussed with reference to the accompanying figures. Further aspects and embodiments will be apparent to those skilled in the art. All documents mentioned in this text are incorporated herein by reference.

SUMMARY

First Mode of the Disclosure: Central Position of Aerosol Generator Portion

At its most general, the first mode of the present disclosure relates to an aerosol delivery device for passive aerosol generation in which a support is configured to maintain an aerosol generator portion in a substantially central position in an air flow passage.

According to the first mode of the present disclosure, there is provided an aerosol delivery device comprising: an aerosol generator portion configured to receive a first aerosol precursor; an air flow passage configured to direct air past the aerosol generator portion to pick up the first aerosol precursor from the aerosol generator portion to form a first aerosol; and a support for maintaining the aerosol generator portion in a substantially central position in the air flow passage.

Optionally, the aerosol delivery device further comprises a mouthpiece, the mouthpiece comprising a mouthpiece aperture forming part of the air flow passage, wherein the support is located in the mouthpiece aperture.

In some embodiments, the support at least partially circumscribes the aerosol generator portion i.e. at least partially circumscribes at outer surface of the aerosol generator portion. Thus the support is an external support.

Advantageously, the support comprises ribs extending radially inwardly from a narrowing section of the air flow passage. The narrowing section of the air flow passage is typically substantially annular.

In some embodiments, the ribs contact and grip an outer surface of the aerosol generator portion. In some embodiments, the ribs may even penetrate the outer surface of the aerosol generator portion.

The ribs may be equally spaced around the circumference of the aerosol generator portion.

Conveniently, the support comprises three ribs (e.g. three equally spaced ribs) extending inwardly from the narrowing section of the air flow passage.

Optionally, the aerosol delivery device comprises a member, the member comprising the aerosol generator portion, wherein the member is configured to transfer the first aerosol precursor to the aerosol generator portion.

Advantageously, the member is formed of a second porous material, the member configured to wick the first aerosol precursor to the aerosol generator portion.

The air flow passage is configured to direct air past the aerosol generator portion to pick up the first aerosol precursor from the aerosol generator portion to form a first aerosol i.e. the aerosol generator portion is a passive aerosol generator portion that generates the first aerosol without the application of heat.

Conveniently, the aerosol delivery device further comprises a storage for storing the first aerosol precursor.

Optionally, the storage comprises a reservoir, the reservoir formed of a first porous material. Advantageously, the storage comprises a tank configured to store the first aerosol precursor as a free liquid.

Conveniently, the first aerosol is sized to inhibit pulmonary penetration, and the first aerosol is transmissible within at least one of a mammalian oral cavity and a mammalian nasal cavity.

Advantageously, the aerosol delivery device is a consumable for a smoking substitute device. Conveniently, the aerosol delivery device comprises a second aerosol generator, the second aerosol generator configured to produce a second aerosol from a second aerosol precursor, wherein the second aerosol is sized for pulmonary penetration.

Optionally, the second aerosol generator is configured to heat the second aerosol precursor to form the second aerosol. Conveniently, the second aerosol generator is located so as to be upstream of the first aerosol generator in use.

Advantageously, the first aerosol precursor comprises a flavour component.

Conveniently, the second aerosol precursor comprises an active component. Optionally, the active component is nicotine.

The first mode of the disclosure includes the combination of the aspects and preferred features described except where such a combination is clearly impermissible or expressly avoided.

Second Mode of the Disclosure: Mouthpiece Aperture with Uneven Inner Surface

At its most general, the second mode of the present disclosure relates to an aerosol delivery device comprising a mouthpiece aperture with an uneven inner surface.

According to the second mode of the present disclosure, there is provided aerosol delivery device comprising: a first aerosol generator configured to produce a first aerosol from a first aerosol precursor, wherein the first aerosol is sized to inhibit pulmonary penetration, and the first aerosol is transmissible within at least one of a mammalian oral cavity and a mammalian nasal cavity; and a mouthpiece comprising a mouthpiece aperture, wherein the mouthpiece aperture is configured to receive the first aerosol in use, wherein the mouthpiece aperture comprises an inner surface, wherein the inner surface is uneven to reduce liquid build up on the inner surface.

Optionally, the inner surface comprises grooves.

Advantageously, the grooves extend in a substantially axial direction. Conveniently, the grooves have a depth of at least 0.2 mm.

Optionally, the inner surface comprises an even portion, wherein the even portion has a polished finish.

Advantageously, the inner surface is angled with respect to an axial direction such that the width of the mouthpiece aperture increases in a downstream direction.

Conveniently, the first aerosol generator comprises: an aerosol generator portion configured to receive the first aerosol precursor; and an air flow passage configured to direct air past the aerosol generator portion to pick up the first aerosol precursor from the aerosol generator portion to form the first aerosol, wherein the mouthpiece aperture forms part of the air flow passage.

Optionally, the aerosol generator comprises a member, the member comprising the aerosol generator portion, wherein the member is configured to transfer the first aerosol precursor to the aerosol generator portion.

Advantageously, the aerosol delivery device comprises a storage for storing the first aerosol precursor. Conveniently, the storage comprises a reservoir, the reservoir formed of a first porous material.

Optionally, the storage comprises a tank configured to store the first aerosol precursor as a free liquid. Advantageously, the aerosol delivery device is a consumable for a smoking substitute device.

Conveniently, the aerosol delivery device comprises a second aerosol generator, the second aerosol generator configured to produce a second aerosol from a second aerosol precursor, wherein the second aerosol is sized for pulmonary penetration.

Optionally, the second aerosol generator is configured to heat the second aerosol precursor to form the second aerosol.

Conveniently, the second aerosol generator is positioned so as to be upstream of the first aerosol generator in use.

Advantageously, the first aerosol precursor comprises a flavour component.

Conveniently, the second aerosol precursor comprises an active component. Optionally, the active component is nicotine.

The invention includes the combination of the aspects and preferred features described except where such a combination is clearly impermissible or expressly avoided.

Third Mode of the Disclosure: Forming an Aerosol Through Passive Aerosol Generation At its most general, the third mode of the present disclosure relates to an aerosol delivery device comprising a reservoir formed of a first porous material and a member formed of a second porous material, the member configured to form an aerosol through passive aerosol generation.

According to the third mode of the present disclosure, there is provided an aerosol delivery device comprising: a reservoir configured to store a first aerosol precursor, wherein the reservoir is formed of a first porous material; and a member comprising an aerosol generator portion, wherein the member is formed of a second porous material, wherein the member is configured to wick the first aerosol precursor from the reservoir to the aerosol generator portion, an air flow passage configured to direct air past the aerosol generator portion to pick up first aerosol precursor from the aerosol generator portion to form a first aerosol.

Optionally, the second porous material has at least 40% porosity. Advantageously, the second porous material has at least 50% porosity. Conveniently, the second porous material has at most 80% porosity.

Optionally, the second porous material has at most 70% porosity.

Advantageously, the first porous material has a density of at least 0.11 g/cm3. Conveniently, the second porous material has a density of at most 0.17 g/cm3.

Optionally, the aerosol delivery device comprises a chamber, the reservoir located in the chamber.

Advantageously, the first aerosol is sized to inhibit pulmonary penetration, and the first aerosol is transmissible within at least one of a mammalian oral cavity and a mammalian nasal cavity.

Optionally, the aerosol delivery device is a consumable for a smoking substitute device.

Advantageously, the aerosol delivery device further comprises a second aerosol generator, the second aerosol generator configured to produce a second aerosol from a second aerosol precursor, wherein the second aerosol is sized for pulmonary penetration.

Conveniently, the second aerosol generator is configured to heat the second aerosol precursor to form the second aerosol.

Advantageously, the first aerosol precursor comprises a flavour component. Conveniently, the second aerosol precursor comprises an active component. Optionally, the active component is nicotine.

Conveniently, the second aerosol generator is positioned so as to be upstream of the first aerosol generator in use.

The third mode of the disclosure includes the combination of the aspects and preferred features described except where such a combination is clearly impermissible or expressly avoided.

Fourth Mode of the Disclosure: Reservoir within the Chamber

At its most general, the fourth mode of the present disclosure relates to an aerosol delivery device comprising a chamber and a reservoir within the chamber, the chamber comprising a chamber aperture.

According to the fourth mode of the present disclosure, there is provided an aerosol delivery device comprising: a chamber; and a reservoir located within the chamber, the reservoir configured to store a first aerosol precursor for forming a first aerosol; and a first aerosol generator configured to generate a first aerosol from the first aerosol precursor, wherein the chamber comprises a chamber aperture, the chamber aperture configured to permit air to enter the chamber as the reservoir empties of first aerosol precursor.

Optionally, the chamber aperture is located in an in use upper portion of the chamber. Advantageously, the aerosol deliver device comprises two said chamber apertures.

Conveniently, the first aerosol generator comprises: an aerosol generator portion configured to receive the first aerosol precursor; and an air flow passage configured to direct air past the aerosol generator portion to pick up the first aerosol precursor from the aerosol generator portion to form the first aerosol.

Optionally, the aerosol generator comprises a member, the member comprising the aerosol generator portion, wherein the member is configured to transfer the first aerosol precursor from the reservoir to the aerosol generator portion.

In some embodiments, the reservoir comprises a first porous material.

Advantageously, the member is formed of a second porous material, the member configured to wick the first aerosol precursor from the reservoir to the aerosol generator portion.

Conveniently, the or each said chamber aperture provides fluid communication between the reservoir and the air flow passage.

Optionally, the air flow passage comprises first and second airflow branches, the reservoir located between the first and second airflow branches.

Advantageously, the first and second airflow branches are configured to provide inward airflow towards the aerosol generator portion.

Conveniently, the chamber apertures are located on opposing sides of the aerosol generator portion.

Optionally, the chamber apertures provide fluid communication between the reservoir and the first and second airflow branches.

Advantageously, the first aerosol is sized to inhibit pulmonary penetration, and the first aerosol is transmissible within at least one of a mammalian oral cavity and a mammalian nasal cavity.

Conveniently, the aerosol delivery device is a consumable for a smoking substitute device.

Optionally, the aerosol delivery device comprises a second aerosol generator, the second aerosol generator configured to produce a second aerosol from a second aerosol precursor, wherein the second aerosol is sized for pulmonary penetration.

Advantageously, the second aerosol generator is configured to heat the second aerosol precursor to form the second aerosol.

Advantageously, the aerosol delivery device is a consumable for a smoking substitute device.

Conveniently, the aerosol delivery device comprises a second aerosol generator, the second aerosol generator configured to produce a second aerosol from a second aerosol precursor, wherein the second aerosol is sized for pulmonary penetration.

Optionally, the second aerosol generator is configured to heat the second aerosol precursor to form the second aerosol.

Conveniently, the second aerosol generator is positioned so as to be upstream of the first aerosol generator in use.

Advantageously, the first aerosol precursor comprises a flavour component.

Conveniently, the second aerosol precursor comprises an active component.

Optionally, the active component is nicotine.

The fourth mode of the present disclosure includes the combination of the aspects and preferred features described except where such a combination is clearly impermissible or expressly avoided.

Fifth Mode of the Disclosure: First and Second Airflow Branches

At its most general, the fifth mode of the present disclosure relates to an aerosol delivery device for passive aerosol generation, in which first and second airflow branches provide inward airflow towards an aerosol generation portion.

According to the fifth mode of the present disclosure, there is provided an aerosol delivery device comprising: a member comprising an aerosol generator portion, wherein the member is configured to transfer a first aerosol precursor to the aerosol generator portion; and an air flow passage configured to direct air past the aerosol generator portion to pick up the first aerosol precursor from the aerosol generator portion to form a first aerosol, wherein the air flow passage comprises first and second airflow branches, the member located between the first and second airflow branches, wherein the first and second airflow branches are configured to provide inward airflow towards the aerosol generator portion Optionally, the aerosol delivery device comprises a storage for storing the first aerosol precursor. Advantageously, the storage is located between the first and second aerosol branches.

Conveniently, the storage comprises a reservoir, the reservoir formed of a first porous material.

Optionally, the aerosol delivery device further comprises a chamber, the reservoir located within the chamber, wherein the chamber comprises a chamber aperture, the chamber aperture configured to permit air to enter the chamber as the reservoir empties of first aerosol precursor.

The aerosol delivery device may comprise two said chamber apertures. Advantageously, the chamber apertures are located on opposing sides of the aerosol generator portion.

Conveniently, the chamber apertures provide fluid communication between the reservoir and the first and second airflow branches.

Optionally, the storage comprises a tank configured to store the first aerosol precursor as a free liquid.

Advantageously, the member is formed of a second porous material, the member configured to wick the first aerosol precursor to the aerosol generator portion.

Conveniently, the first aerosol is sized to inhibit pulmonary penetration, and the first aerosol is transmissible within at least one of a mammalian oral cavity and a mammalian nasal cavity.

Advantageously, the aerosol delivery device is a consumable for a smoking substitute device.

Conveniently, the aerosol delivery device comprises a second aerosol generator, the second aerosol generator configured to produce a second aerosol from a second aerosol precursor, wherein the second aerosol is sized for pulmonary penetration.

Optionally, the second aerosol generator is configured to heat the second aerosol precursor to form the second aerosol.

Conveniently, the second aerosol generator is located so as to be upstream of the first aerosol generator in use.

Advantageously, the first aerosol precursor comprises a flavour component.

Conveniently, the second aerosol precursor comprises an active component. Optionally, the active component is nicotine.

The fifth mode of the disclosure includes the combination of the aspects and preferred features described except where such a combination is clearly impermissible or expressly avoided.

Sixth Mode of the Disclosure: Limited Area of Air Flow Passage

At its most general, the sixth mode of the present disclosure relates to aerosol delivery device for passive aerosol generation in which an air flow passage has a cross-sectional area of at most 2.0 $mm^2$ at the aerosol generator portion.

According to the present invention, there is provided an aerosol delivery device comprising: an aerosol generator portion configured to receive a first aerosol precursor; and an air flow passage configured to direct air past the aerosol generator portion to pick up the first aerosol precursor from the aerosol generator portion to form a first aerosol, wherein the air flow passage has a cross-sectional area of at most 2.0 $mm^2$ at the aerosol generator portion.

It has been found that providing an air flow passage having a cross-sectional area of 2.0 $mm^2$ at most at the aerosol generator portion increases the spray mass of the first aerosol.

Optionally, the air flow passage has a cross-sectional area of at most 1.5 $mm^2$ at the aerosol generator portion. Advantageously, the air flow passage has a cross-sectional area of at most 1.4 $mm^2$ at the aerosol generator portion. Conveniently, the air flow passage has a cross-sectional area of at most 1.3 $mm^2$ at the aerosol generator portion. Optionally, the air flow passage has a cross-sectional area of at most 1.2 $mm^2$ at the aerosol generator portion. Advantageously, the air flow passage has a cross-sectional area of at most 1.1 $mm^2$ at the aerosol generator portion.

Conveniently, the air flow passage has a cross-sectional area of at least 0.5 $mm^2$ at the aerosol generator portion. Optionally, the air flow passage has a cross-sectional area of at least 0.6 $mm^2$ at the aerosol generator portion. Advantageously, the air flow passage has a cross-sectional area of at least 0.7 $mm^2$ at the aerosol generator portion. Conveniently, the air flow passage has a cross-sectional area of at least 0.8 $mm^2$ at the aerosol generator portion. Optionally, the air flow passage has a cross-sectional area of at least 0.9 $mm^2$ at the aerosol generator portion.

In preferred embodiments, the air flow passage has a cross-sectional area at the aerosol generator portion of equal to or greater than 0.5, 0.6, 0.7, 0.8 or 0.9 $mm^2$. In these preferred embodiments, the air flow passage has a cross-sectional area at the aerosol generator portion of equal to or less than 1.5, 1.4, 1.3, 1.2 or 1.1 $mm^2$. Thus, the air flow passage at the aerosol generator portion may, for example, have a cross-sectional area of between 0.5 and 1.5 or 1.4 or 1.3 or 1.2 or 1.1 $mm^2$, or a cross-sectional area of between 0.8 and 1.5 or 1.4 or 1.3 or 1.2 or 1.1 $mm^2$, or a cross-sectional area of between 0.9 and 1.5 or 1.4 or 1.3 or 1.2 or 1.1 $mm^2$. Possible preferred ranges may be 0.8-1.5 $mm^2$, 0.9-1.5 $mm^2$, 0.8-1.4 $mm^2$, 0.9-1.4 $mm^2$, 0.8-1.3 $mm^2$, 0.9-1.3 $mm^2$, 0.8-1.2 $mm^2$, 0.9-1.2 $mm^2$, 0.8-1.1 $mm^2$ or 0.9-1.1 $mm^2$, for example. The preferred ranges have been found to be particularly effective at increasing the spray mass of the first aerosol.

Advantageously, the aerosol delivery device further comprises a mouthpiece, the mouthpiece comprising a mouthpiece aperture forming part of the air flow passage.

Conveniently, the aerosol delivery device further comprises a member, the member comprising the aerosol generator portion, wherein the member is configured to transfer the first aerosol precursor to the aerosol generator portion.

Optionally, the air flow passage comprises first and second airflow branches, the member located between the first and second airflow branches, wherein the first and second airflow branches are configured to provide inward airflow towards the aerosol generator portion.

Advantageously, the member is formed of a second porous material, the member configured to wick the first aerosol precursor to the aerosol generator portion.

Conveniently, the aerosol generator portion further comprises a storage for storing the first aerosol precursor.

Optionally, the storage comprises a reservoir, the reservoir formed of a first porous material.

Advantageously, the storage comprises a tank configured to store the first aerosol precursor as a free liquid.

Conveniently, the aerosol delivery devices comprises further comprising a support for maintaining the aerosol generator portion in a substantially central position in the air flow passage.

Optionally, the first aerosol is sized to inhibit pulmonary penetration, and the first aerosol is transmissible within at least one of a mammalian oral cavity and a mammalian nasal cavity.

Advantageously, the aerosol delivery device is a consumable for a smoking substitute device.

Conveniently, the aerosol delivery device comprises a second aerosol generator, the second aerosol generator configured to produce a second aerosol from a second aerosol precursor, wherein the second aerosol is sized for pulmonary penetration.

Optionally, the second aerosol generator is configured to heat the second aerosol precursor to form the second aerosol.

Conveniently, the second aerosol generator is located so as to be upstream of the first aerosol generator in use.

Advantageously, the first aerosol precursor comprises a flavour component.

Conveniently, the second aerosol precursor comprises an active component. Optionally, the active component is nicotine.

The sixth mode of the disclosure includes the combination of the aspects and preferred features described except where such a combination is clearly impermissible or expressly avoided.

Seventh Mode of the Disclosure: Enhanced Atomizing Area

At its most general, the seventh mode of the present disclosure relates to aerosol delivery device for passive aerosol generation, in which an aerosol generator portion has an atomising area of more than 10 $mm^2$.

According to the seventh mode of the present disclosure, there is provided an aerosol delivery device comprising: an aerosol generator portion configured to receive a first aerosol precursor; and an air flow passage configured to direct air past the aerosol generator portion to pick up the first aerosol precursor from the aerosol generator portion to form a first aerosol, wherein the aerosol generator portion has an atomising area of more than 10 $mm^2$.

Optionally, the aerosol generator portion has an atomising area of more than 16 $mm^2$. Advantageously, the aerosol generator portion has an atomising area of more than 18 $mm^2$. Conveniently, the aerosol generator portion has an atomising area of more than 20 $mm^2$. Optionally, the aerosol generator portion has an atomising area of more than 22 $mm^2$.

Advantageously, the aerosol generator portion has an atomising area of no more than 36 $mm^2$. Conveniently, the aerosol generator portion has an atomising area of no more than 30 $mm^2$. Optionally, the aerosol generator portion has an atomising area of no more than 28 $mm^2$. Advantageously, the aerosol generator portion has an atomising area of no more than 26 $mm^2$. Conveniently, the aerosol generator portion has an atomising area of no more than 24 $mm^2$.

Optionally, the aerosol delivery device further comprises a member, the member comprising the aerosol generator portion, wherein the member is configured to transfer the first aerosol precursor to the aerosol generator portion.

Advantageously, the member is formed of a second porous material, the member configured to wick the first aerosol precursor to the aerosol generator portion.

Conveniently, the aerosol delivery device comprises a storage for storing the first aerosol precursor. Optionally, the storage comprises a reservoir, the reservoir formed of a first porous material.

Advantageously, the storage comprises a tank configured to store the first aerosol precursor as a free liquid.

Conveniently, the first aerosol is sized to inhibit pulmonary penetration, and the first aerosol is transmissible within at least one of a mammalian oral cavity and a mammalian nasal cavity.

Advantageously, the aerosol delivery device is a consumable for a smoking substitute device.

Conveniently, the aerosol delivery device comprises a second aerosol generator, the second aerosol generator configured to produce a second aerosol from a second aerosol precursor, wherein the second aerosol is sized for pulmonary penetration.

Optionally, the second aerosol generator is configured to heat the second aerosol precursor to form the second aerosol.

Conveniently, the second aerosol generator is located so as to be upstream of the first aerosol generator in use.

Advantageously, the first aerosol precursor comprises a flavour component.

Conveniently, the second aerosol precursor comprises an active component.

Optionally, the active component is nicotine.

The seventh mode of the present disclosure includes the combination of the aspects and preferred features described except where such a combination is clearly impermissible or expressly avoided.

Eighth Mode of the Disclosure: Enhanced Member for Passive Aerosol Generation

At its most general, the eighth mode of the present disclosure relates to an aerosol delivery device comprising a storage and member for passive aerosol generation, the member extending into the storage by at least 50% of the length of the storage.

According to the eighth mode of the present disclosure, there is provided an aerosol delivery device comprising: a storage configured to store a first aerosol precursor, the storage having a length; a member comprising an aerosol generator portion, wherein the member is configured to transfer the first aerosol precursor from the storage to the aerosol generator portion, the member extending into the storage by at least 50% of the length of the storage; and an air flow passage configured to direct air past the aerosol generator portion to pick up the first aerosol precursor from the aerosol generator portion to form a first aerosol.

Optionally, the member extends into the storage by at least 60% of the length of the storage. Advantageously, the member extends into the storage by at least 70% of the length of the storage. Conveniently, the member extends into the storage by at least 80% of the length of the storage. Optionally, the member extends into the storage by at least 90% of the length of the storage. Advantageously, the member extends all of the way through the storage.

Conveniently, the storage comprises a reservoir, the reservoir formed of a first porous material. Optionally, the storage comprises a tank configured to store the first aerosol precursor as a free liquid.

Advantageously, the member is formed of a second porous material, the member configured to wick the first aerosol precursor to the aerosol generator portion.

Conveniently, the first aerosol is sized to inhibit pulmonary penetration, and the first aerosol is transmissible within at least one of a mammalian oral cavity and a mammalian nasal cavity.

Optionally, the aerosol delivery device is a consumable for a smoking substitute device.

Conveniently, the aerosol delivery device comprises a second aerosol generator, the second aerosol generator configured to produce a second aerosol from a second aerosol precursor, wherein the second aerosol is sized for pulmonary penetration.

Optionally, the second aerosol generator is configured to heat the second aerosol precursor to form the second aerosol.

Conveniently, the second aerosol generator is located so as to be upstream of the first aerosol generator in use.

Advantageously, the first aerosol precursor comprises a flavour component.

Conveniently, the second aerosol precursor comprises an active component.

Optionally, the active component is nicotine.

The eighth mode of the present disclosure includes the combination of the aspects and preferred features described except where such a combination is clearly impermissible or expressly avoided.

Ninth Mode of the Disclosure: Enhanced Total Particle Mass of First Aerosol

At its most general, the ninth mode of the present disclosure relates to an aerosol delivery device configured to produce more than 1.0 mg total particle mass (TPM) of a first aerosol per delivery event.

According to the ninth mode of the present disclosure, there is provided an aerosol delivery device comprising: an aerosol generator configured to produce, during a delivery event, a first aerosol from a first aerosol precursor, wherein the first aerosol is sized to inhibit pulmonary penetration, and the first aerosol is transmissible within at least one of a mammalian oral cavity and a mammalian nasal cavity, wherein the aerosol generator is configured to produce more than 1.0 mg TPM of first aerosol per delivery event.

Optionally, the aerosol generator is configured to produce more than more than 1.5 mg TPM of first aerosol per delivery event. Advantageously, the aerosol generator is configured to produce more than more than 2.0 mg TPM of first aerosol per delivery event. Conveniently, the aerosol generator is configured to produce more than more than 2.5 mg TPM of first aerosol per delivery event. Optionally, the aerosol generator is configured to produce more than 3.0 mg TPM of first aerosol per delivery event.

Conveniently, the aerosol generator is configured to produce less than 20.0 mg TPM of first aerosol per delivery event. Optionally, the aerosol generator is configured to produce less than 13.0 mg TPM of first aerosol per delivery event. Advantageously, the aerosol generator is configured to produce less than 10.0 mg TPM of first aerosol per delivery event. Conveniently, the aerosol generator is configured to produce less than 8.0 mg TPM of first aerosol per delivery event. Optionally, the aerosol generator is configured to produce less than 6.0 mg TPM of first aerosol per delivery event. Conveniently, the aerosol generator is configured to produce less than 4.0 mg TPM of first aerosol per delivery event.

Advantageously, the first aerosol generator comprises: an aerosol generator portion configured to receive the first aerosol precursor; and an air flow passage configured to direct air past the aerosol generator portion to pick up the first aerosol precursor from the aerosol generator portion to form the first aerosol, wherein the mouthpiece aperture forms part of the air flow passage.

Conveniently, the aerosol generator comprises a member, the member comprising the aerosol generator portion, wherein the member is configured to transfer the first aerosol precursor to the aerosol generator portion.

Optionally, the member is formed of a second porous material, the member configured to wick the first aerosol precursor to the aerosol generator portion.

Advantageously, the aerosol delivery device comprises a storage for storing the first aerosol precursor. Conveniently, the storage comprises a reservoir, the reservoir formed of a first porous material. Optionally, the storage comprises a tank configured to store the first aerosol precursor as a free liquid.

Advantageously, the aerosol delivery device is a consumable for a smoking substitute device.

Conveniently, the first aerosol is sized to inhibit pulmonary penetration, and the first aerosol is transmissible within at least one of a mammalian oral cavity and a mammalian nasal cavity.

Advantageously, the aerosol delivery device is a consumable for a smoking substitute device.

Conveniently, the aerosol delivery device comprises a second aerosol generator, the second aerosol generator configured to produce a second aerosol from a second aerosol precursor, wherein the second aerosol is sized for pulmonary penetration.

Optionally, the second aerosol generator is configured to heat the second aerosol precursor to form the second aerosol.

Advantageously, the first aerosol precursor comprises a flavour component.

Conveniently, the second aerosol precursor comprises an active component.

Optionally, the active component is nicotine.

Conveniently, the second aerosol generator is positioned so as to be upstream of the first aerosol generator in use.

The ninth mode of the present disclosure includes the combination of the aspects and preferred features described except where such a combination is clearly impermissible or expressly avoided.

Tenth Mode of the Disclosure: Tank Aperture

At its most general, the tenth mode of the present disclosure relates to an aerosol delivery device comprising a tank with a tank aperture, the tank aperture configured to permit air flow into the tank as the tank empties.

According to the tenth mode of the present disclosure, there is provided an aerosol delivery device comprising: a tank configured to store a first aerosol precursor for forming a first aerosol; and a tank aperture providing fluid communication between the tank and an exterior of the tank, the tank aperture configured to permit air flow into the tank as the tank empties, the tank aperture configured to inhibit flow of first aerosol precursor out of the tank.

Optionally, the tank aperture comprises a non-return valve, the non-return valve configured to prevent flow of first aerosol precursor out of the tank, the non-return valve configured to permit flow of air into the tank as the tank empties.

Advantageously, the non-return valve is a duckbill valve.

Conveniently, the tank aperture comprises a plug, wherein the plug is formed of a matrix material, wherein the matrix material permits flow of air but inhibits flow of first aerosol precursor through the matrix material.

Optionally, the plug is saturated with first aerosol precursor.

Advantageously, the matrix material is polyetherimide (PEI).

Conveniently, the tank aperture provides fluid communication between the tank and an exterior of the aerosol delivery device.

Optionally, the aerosol delivery device comprises: an aerosol generator portion configured to receive the first aerosol precursor; and an air flow passage configured to direct air past the aerosol generator portion to pick up the first aerosol precursor from the aerosol generator portion to form the first aerosol.

Advantageously, the aerosol delivery device comprises a member, the member comprising the aerosol generator portion, wherein the member is configured to transfer the first aerosol precursor from the tank to the aerosol generator portion.

Conveniently, the plug maintains the member in position.

Optionally, the tank aperture provides fluid communication between the tank and the airflow passage.

Advantageously, the first aerosol is sized to inhibit pulmonary penetration, and the first aerosol is transmissible within at least one of a mammalian oral cavity and a mammalian nasal cavity.

Conveniently, the tank aperture is located in an in use upper portion of the tank.

Conveniently, the first aerosol is sized to inhibit pulmonary penetration, and the first aerosol is transmissible within at least one of a mammalian oral cavity and a mammalian nasal cavity Advantageously, the aerosol delivery device is a consumable for a smoking substitute device.

Conveniently, the aerosol delivery device comprises a second aerosol generator, the second aerosol generator configured to produce a second aerosol from a second aerosol precursor, wherein the second aerosol is sized for pulmonary penetration.

Optionally, the second aerosol generator is configured to heat the second aerosol precursor to form the second aerosol.

Conveniently, the second aerosol generator is positioned to as to be upstream of the first aerosol generator in use.

Advantageously, the first aerosol precursor comprises a flavour component.

Conveniently, the second aerosol precursor comprises an active component.

Optionally, the active component is nicotine.

The tenth mode of the present disclosure includes the combination of the aspects and preferred features described except where such a combination is clearly impermissible or expressly avoided.

Eleventh Mode of the Disclosure: Mutually Engaging Features

At its most general, the eleventh mode of the present disclosure relates to an aerosol delivery device comprising mutually engaging features to maintain a member in the aerosol delivery device.

According to the eleventh mode of the present disclosure, there is provided an aerosol delivery device comprising: a member comprising an aerosol generator portion, the aerosol generator portion configured to receive a first aerosol precursor; and an air flow passage configured to direct air past the aerosol generator portion to pick up the first aerosol precursor from the aerosol generator portion to form a first aerosol, wherein the member and the aerosol delivery device comprise mutually engaging features to maintain the member in the aerosol delivery device.

Optionally, the mutually engaging features comprise a groove and a protrusion.

Advantageously, the aerosol delivery device comprises a tube for receiving the member.

Conveniently, an internal surface of the tube comprises the protrusion and the member comprises the groove.

Optionally, the member is formed of a porous material.

Advantageously, the groove is formed by a grinding process.

Conveniently, the mutually engaging features comprise a barb and a deformable surface for receiving the barb.

Optionally, the aerosol delivery device comprises a slit, the slit providing the barb, and the deformable surface is a surface of the member.

Advantageously, the slit is substantially cross-shaped.

Conveniently, the aerosol delivery device comprises a storage for storing the first aerosol precursor, the member configured to transfer the first aerosol precursor from the storage to the aerosol generator portion Optionally, the tube extends into the storage.

Advantageously, the storage comprises a reservoir, the reservoir formed of a porous material.

Conveniently, the storage comprises a tank configured to store the first aerosol precursor as a free liquid.

Conveniently, the first aerosol is sized to inhibit pulmonary penetration, and the first aerosol is transmissible within at least one of a mammalian oral cavity and a mammalian nasal cavity Advantageously, the aerosol delivery device is a consumable for a smoking substitute device.

Conveniently, the aerosol delivery device comprises a second aerosol generator, the second aerosol generator configured to produce a second aerosol from a second aerosol precursor, wherein the second aerosol is sized for pulmonary penetration.

Optionally, the second aerosol generator is configured to heat the second aerosol precursor to form the second aerosol.

Conveniently, the second aerosol generator is configured to be positioned upstream of the first aerosol generator in use.

Advantageously, the first aerosol precursor comprises a flavour component.

Conveniently, the second aerosol precursor comprises an active component. Optionally, the active component is nicotine.

The eleventh mode of the disclosure includes the combination of the aspects and preferred features described except where such a combination is clearly impermissible or expressly avoided.

Twelfth Mode of the Disclosure: Methods of Assembly an Aerosol Delivery Device

At its most general, the twelfth of the present disclosure relates to a method comprising inserting a reservoir formed of a porous material into a chamber through an insertion aperture, the reservoir returning to a substantially uncompressed state in the chamber, wherein in the substantially uncompressed state the reservoir is wider than the insertion aperture.

According to the twelfth mode of the present disclosure, there is provided a method of assembling an aerosol delivery device, wherein the aerosol delivery device comprises a chamber, the chamber comprising an insertion aperture, the method comprising: compressing a reservoir to a compressed state, wherein the reservoir is configured to store a first aerosol precursor for forming a first aerosol, wherein the reservoir is formed of a first porous material; and inserting the reservoir into the chamber through the insertion aperture whilst in said compressed state, the reservoir returning to a substantially uncompressed state in the chamber.

Optionally, said step of compressing the reservoir comprises inserting the reservoir into a sleeve, and said step of inserting the reservoir comprises pushing the reservoir out of the sleeve and into the chamber.

Advantageously, said step of inserting the reservoir comprises pushing the reservoir out of the sleeve while the sleeve is at least partially inserted through the insertion aperture.

Conveniently, said step of inserting the reservoir comprises pushing the reservoir out of the sleeve using a tool.

Optionally, the method further comprises inserting a member into the reservoir, wherein the member comprises an aerosol generator portion, wherein the member is configured to transfer a first aerosol precursor from the reservoir to the aerosol generator portion.

Advantageously, the member pierces the reservoir during insertion of the member into the reservoir.

Conveniently, the member comprises a tapered end, the tapered end piercing the reservoir during insertion of the member into the reservoir.

Optionally, the member is formed of a second porous material, the member configured to wick the first aerosol precursor from the reservoir to the aerosol generator portion.

Advantageously, said step of inserting the member into the reservoir comprises pushing the member against a tool.

Conveniently, the first aerosol is sized to inhibit pulmonary penetration, and the first aerosol is transmissible within at least one of a mammalian oral cavity and a mammalian nasal cavity.

Optionally, the aerosol delivery device comprises an air flow passage configured to direct air past the aerosol generator portion to pick up the first aerosol precursor from the aerosol generator portion to form the first aerosol Advantageously, the aerosol delivery device is a consumable for a smoking substitute device.

Conveniently, the aerosol delivery device comprises a second aerosol generator, the second aerosol generator configured to produce a second aerosol from a second aerosol precursor, wherein the second aerosol is sized for pulmonary penetration.

Optionally, the second aerosol generator is configured to heat the second aerosol precursor to form the second aerosol.

Advantageously, the first aerosol precursor comprises a flavour component.

Conveniently, the second aerosol precursor comprises an active component.

Optionally, the active component is nicotine.

Conveniently, the second aerosol generator is positioned so as to be upstream of the first aerosol generator in use.

According to a second aspect of the twelfth mode of the present disclosure, there is provided an aerosol delivery device comprising: a chamber comprising an insertion aperture; and a reservoir located within the chamber, the reservoir configured to store a first aerosol precursor for forming a first aerosol, wherein the reservoir is formed of a porous material, wherein the reservoir is in a substantially uncompressed state, wherein in the substantially uncompressed state the reservoir is wider than the insertion aperture.

Optionally, the aerosol delivery device of the second aspect of the twelfth mode of the present disclosure comprises any of the features of the aerosol delivery device described above in relation to the first aspect of the twelfth mode of the present disclosure.

The twelfth mode of the present disclosure includes the combination of the aspects and preferred features described except where such a combination is clearly impermissible or expressly avoided.

DETAILED DESCRIPTION

Figure 2:
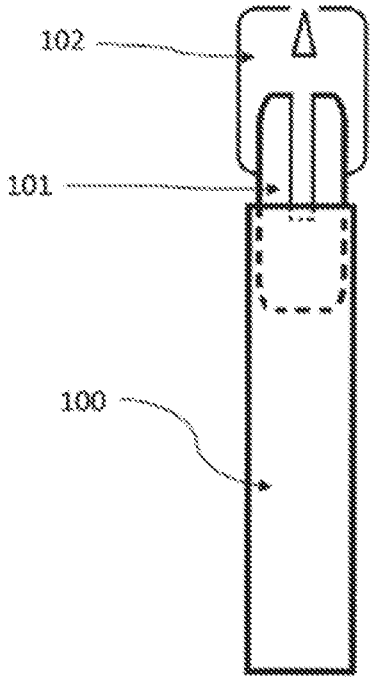
FIG. 2 shows a schematic drawing of a smoking substitute system.

Referring to FIGS. 1 and 2, there is shown a smoking substitute system comprising a smoking substitute device 100. In this example, the substitute smoking system comprises a cartomiser 101 and a flavour pod The cartomiser 101 may engage with the smoking substitute device 100 via a push-fit engagement, a screw-thread engagement, or a bayonet fit, for example. A cartomiser may also be referred to as a "pod". The smoking substitute system may be an aerosol delivery device according to the present invention.

The flavour pod 102 is configured to engage with the cartomiser 101 and thus with the substitute smoking device 100. The flavour pod 102 may engage with the cartomiser 101 via a push-fit engagement, a screw-thread engagement, or a bayonet fit, for example. FIG. 2 illustrates the cartomiser 101 engaged with the substitute smoking device 100, and the flavour pod 102 engaged with the cartomiser 101. As will be appreciated, in this example, the cartomiser 101 and the flavour pod 102 are distinct elements. Each of the cartomiser 101 and the flavour pod may be an aerosol delivery device according to the present disclosure.

As will be appreciated from the following description, the cartomiser 101 and the flavour pod 102 may alternatively be combined into a single component that implements the functionality of the cartomiser 101 and flavour pod 102. Such a single component may also be an aerosol delivery device according to the present invention. In other examples, the cartomiser may be absent, with only a flavour pod 102 present.

A "consumable" component may mean that the component is intended to be used once until exhausted, and then disposed of as waste or returned to a manufacturer for reprocessing.

Figure 3:
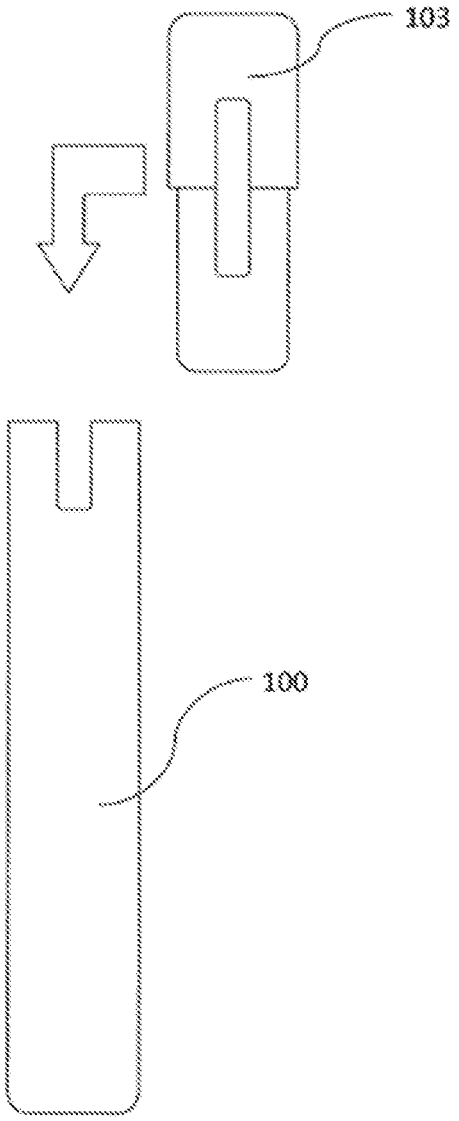
FIG. 3 shows a schematic drawing of a smoking substitute system.
Figure 4:
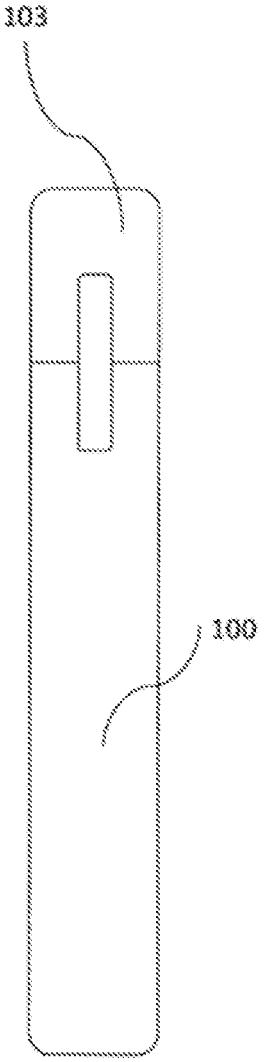
FIG. 4 shows a schematic drawing of a smoking substitute system.

Referring to FIGS. 3 and 4, there is shown a smoking substitute system comprising a smoking substitute device 100 and a consumable 103. The consumable 103 combines the functionality of the cartomiser 101 and the flavour pod 102. In FIG. 3, the consumable 103 and the smoking substitute device 100 are shown separated from one another. In FIG. 4, the consumable 103 and the smoking substitute device 100 are engaged with each other.

Figure 5:
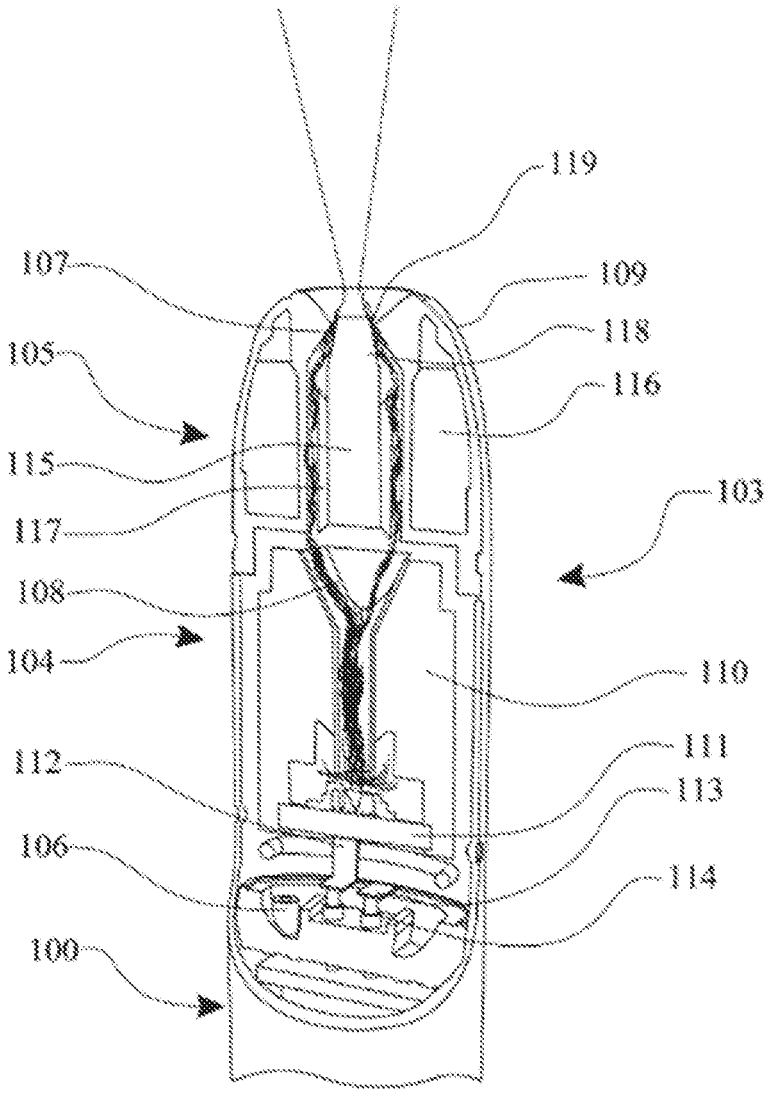
FIG. 5 shows a cutaway view of a consumable.

Referring to FIG. 5, there is shown a consumable 103 engaged with a smoking substitute device 100 via a push-fit engagement. The consumable 103 may be considered to have two portions—a cartomiser portion 104 and a flavour pod portion 105, both of which are located within a single component (as in FIGS. 3 and 4).

The consumable 103 includes an upstream airflow inlet 106 and a downstream airflow outlet 107. In other examples a plurality of inlets and/or outlets are included. Between and fluidly connecting the inlet 106 and the outlet 107 there is an airflow passage 108. The outlet 107 is located at the mouthpiece 109 of the consumable 103, and is formed by a mouthpiece aperture.

As above, the consumable 103 includes a flavour pod portion 105. The flavour pod portion 105 is configured to generate a first (flavour) aerosol for output from the outlet 107 of the mouthpiece 109 of the consumable.

The flavour pod portion 105 of the consumable 103 includes a member 115. The member 115 acts as a passive aerosol generator (i.e. an aerosol generator which does not use heat to form the aerosol, also referred to as a "first aerosol generator" in this example), and is formed of a porous material. The member 115 comprises a supporting portion 117, which is located inside a housing, and an aerosol generator portion 118, which is located in the airflow passage 108. In this example, the aerosol generator portion 118 is a porous nib.

A first storage 116 (in this example a tank) for storing a first aerosol precursor (i.e. a flavour liquid) is fluidly connected to the member 115. The porous nature of the member 115 means that flavour liquid from the first storage 116 is drawn into the member 115. As the first aerosol precursor in the member 115 is depleted in use, further flavour liquid is drawn from the first storage 116 into the member 115 via a wicking action.

As described above, the aerosol generator portion 118 is located within the airflow passage 108 through the consumable 103. The aerosol generator portion 118 therefore constricts or narrows the airflow passage 108. The aerosol generator portion 118 occupies some of the area of the airflow passage, resulting in constriction of the airflow passage 108. The airflow passage 108 is narrowest adjacent to the aerosol generator portion 118. Since the constriction results in increase air velocity and corresponding reduction in air pressure at the aerosol generator portion 118, the constriction is a Venturi aperture 119.

The cartomiser portion 104 of the consumable 103 includes a second storage 110 (in this example a tank) for storing a second aerosol precursor (i.e. e-liquid, which may contain nicotine). Extending into the second storage 110 is a wick 111. The wick 111 is formed from a porous wicking material (e.g. a polymer) that draws second aerosol precursor from the second storage 110 into a central region of the wick 111 that is located outside the e-liquid storage tank 110.

A heater 112 is a configured to heat the central region of the wick 111. The heater 112 includes a resistive heating filament that is coiled around the central region of the wick 111. The wick 111, the heater 112 and the e-liquid storage tank 110 together act as an active aerosol generator (i.e. an aerosol generator which uses heat to form the aerosol, referred to as a "second aerosol generator" in this example).

As described above, the first and second aerosol generators are both at least partially located within the airflow passage 108, with the first aerosol generator downstream (with respect to air flow in use) of the second aerosol generator.

So that the consumable 103 may be supplied with electrical power for activation of the heater 112, the consumable 103 includes a pair of consumable electrical contacts 113. The consumable electrical contacts 113 are configured for electrical connection to a corresponding pair of electrical supply contacts 114 in the smoking substitute device 100. The consumable electrical contacts 113 are electrically connected to the electrical supply contacts 114 when the consumable 103 is engaged with the smoking substitute device 100. The smoking substitute device 100 includes an electrical power source (not shown), for example a battery.

In use, a user draws (or "sucks", or "pulls") on the mouthpiece 109 of the consumable 103, which causes a drop in air pressure at the outlet 107, thereby generating air flow through the inlet 106, along the airflow passage 108, out of the outlet 107 and into the user's mouth.

When the heater 112 is activated (by passing an electric current through the heating filament in response to the user drawing on the mouthpiece 109) the e-liquid located in the wick 111 adjacent to the heating filament is heated and vaporised to form a vapour. The vapour condenses to form the second aerosol within the airflow passage 108. Accordingly, the second aerosol is entrained in an airflow along the airflow flow passage 108 to the outlet 107 and ultimately out from the mouthpiece 109 for inhalation by the user when the user 10 draws on the mouthpiece 109.

The substitute smoking device 100 supplies electrical current to the consumable electrical contacts 113. This causes an electric current flow through the heating filament of the heater 112 and the heating filament heats up. As described, the heating of the heating filament causes vaporisation of the e-liquid in the wick 111 to form the second aerosol.

As the air flows up through the airflow passage 108, it encounters the aerosol generator portion 118. The constriction of the airflow passage 108 caused by the aerosol generator portion 118 results in an increase in air velocity and corresponding decrease in air pressure in the airflow in the vicinity of the porous surface 118 of the aerosol generator portion 115. The corresponding low pressure region causes the generation of the first (flavour) aerosol from the porous surface 118 of the aerosol generator portion 118. The first (flavour) aerosol is entrained into the airflow and ultimately is output from the outlet 107 of the consumable 103 and thus from the mouthpiece 109 into the user's mouth.

The first aerosol is sized to inhibit pulmonary penetration. The first aerosol is formed of particles with a mass median aerodynamic diameter that is greater than or equal to 15 microns, in particular, greater than 30 microns, more particularly greater than 50 microns, yet more particularly greater than 60 microns, and even more particularly greater than 70 microns.

The first aerosol is sized for transmission within at least one of a mammalian oral cavity and a mammalian nasal cavity. The first aerosol is formed by particles having a maximum mass median aerodynamic diameter that is less than 300 microns, in particular less than 200 microns, yet more particularly less than 100 microns. Such a range of mass median aerodynamic diameter will produce aerosols which are sufficiently small to be entrained in an airflow caused by a user drawing air through the flavour element and to enter and extend through the oral and or nasal cavity to activate the taste and/or olfactory receptors.

The second aerosol generated is sized for pulmonary penetration (i.e. to deliver an active ingredient such as nicotine to the user's lungs). The second aerosol is formed of particles having a mass median aerodynamic diameter of less than or equal to 10 microns, preferably less than 8 microns, more preferably less than 5 microns, yet more preferably less than 1 micron. Such sized aerosols tend to penetrate into a human user's pulmonary system, with smaller aerosols generally penetrating the lungs more easily. The second aerosol may also be referred to as a vapour.

The size of aerosol formed without heating is typically smaller than that formed by condensation of a vapour.

As a brief aside, it will be appreciated that the mass median aerodynamic diameter is a statistical measurement of the size of the particles/droplets in an aerosol. That is, the mass median aerodynamic diameter quantifies the size of the droplets that together form the aerosol. The mass median aerodynamic diameter may be defined as the diameter at which 50% of the particles/droplets by mass in the aerosol are larger than the mass median aerodynamic diameter and 50% of the particles/droplets by mass in the aerosol are smaller than the mass median aerodynamic diameter. The "size of the aerosol", as may be used herein, refers to the size of the particles/droplets that are comprised in the particular aerosol.

Figure 6:
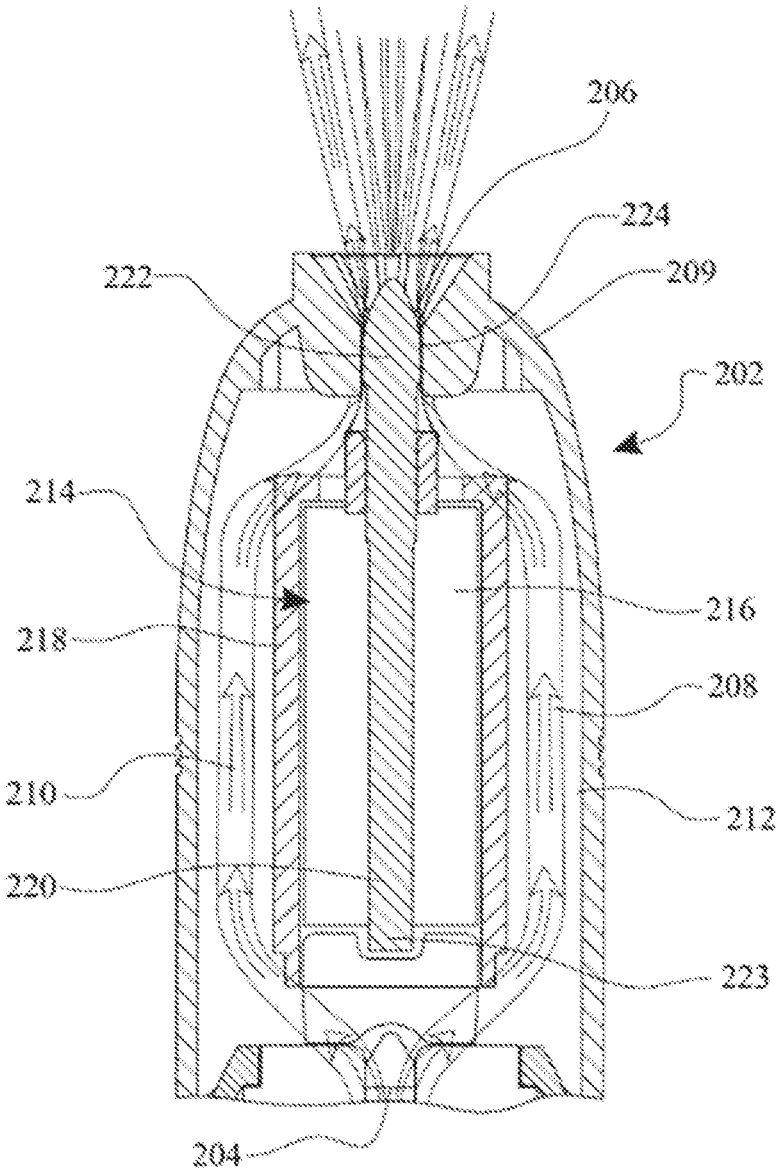
FIG. 6 shows a cross-sectional view of a flavour pod portion of a consumable.
Figure 7A:
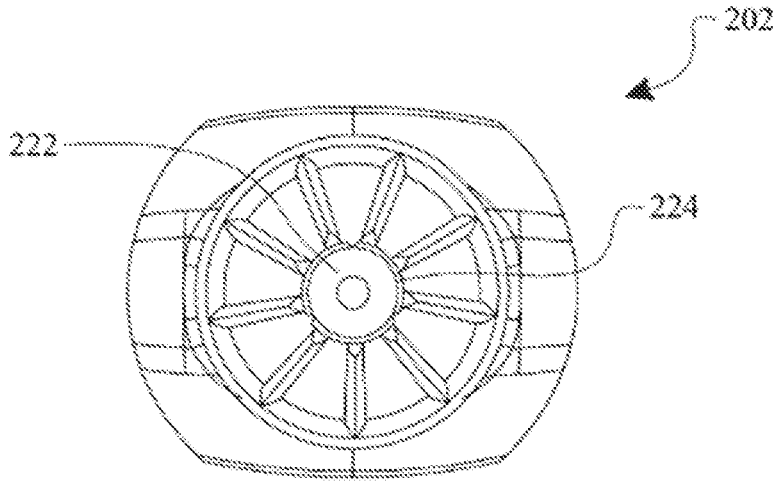
FIG. 7*a* shows a top view of a flavour pod portion of a consumable.
Figure 7B:
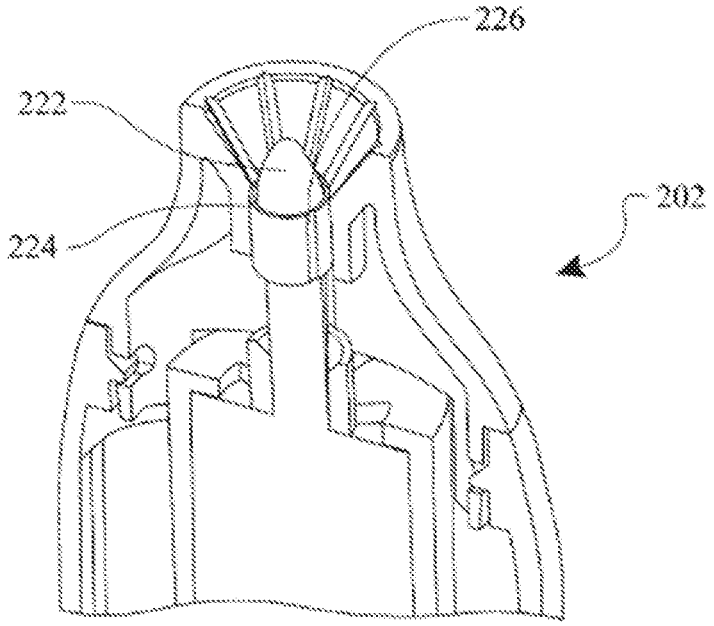
FIG. 7*b* shows a perspective cross-sectional view of a flavour pod portion of a consumable.

Referring to FIG. 6, FIG. 7*a* and FIG. 7*b*, there is shown a flavour pod portion 202 of a consumable, the consumable providing an aerosol delivery device in accordance with the invention. For clarity, many reference numerals are omitted from FIGS. 7*a* and 7*b*. The consumable further comprises a cartomiser portion (not shown in FIG. 6) having all of the features of the cartomiser portion 104 described above with respect to FIG. 5. However, in other examples, the consumable does not comprise the cartomiser portion, and provides only flavour to the user.

The flavour pod portion 202 comprises an upstream (i.e. upstream with respect to flow of air in use) inlet 204 and a downstream (i.e. downstream with respect to flow of air in use) outlet 206. Between and fluidly connecting the inlet 204 and the outlet 206 the flavour pod portion 204 comprises an airflow passage 208. The airflow passage 208 comprises a first airflow branch 210 and a second airflow branch 212, each of the first airflow branch 210 and the second airflow branch 212 fluidly connecting the inlet 204 and the outlet 206. In other examples the airflow passage 208 may have an annular shape. The outlet 206 is located at the mouthpiece 209 of the consumable 103, and is also referred to as a mouthpiece aperture 206.

The flavour pod portion 202 comprises a storage 214, which stores a first aerosol precursor. The storage 214 comprises a reservoir 216 located within a chamber 218. The reservoir 216 is formed of a first porous material. The reservoir 216 is a fibrous material. The fibrous material may be cotton or polyester fibre. The first aerosol precursor is stored in the reservoir 216 due to surface tension in the first aerosol precursor. The first aerosol precursor a viscosity of 5.5209 cP (+/−20%) and a density of 1.0407 g/m (+/−20%).

The first porous material has a density of at least 0.10 $g/cm^3$. More specifically, the first porous material has a density of at least 0.11 $g/cm^3$. More specifically, the first porous material has a density of at least 0.12 $g/cm^3$. More specifically, the first porous material has a density of at least 0.13 $g/cm^3$.

The first porous material has a density of at most 0.17 $g/cm^3$. More specifically, the first porous material has a density of at most 0.16 $g/cm^3$. More specifically, the first porous material has a density of at most 0.15 $g/cm^3$.

More specifically, the first porous material has a density of substantially 0.14 $g/cm^3$.

The chamber 218 comprises an insertion aperture 226, through which the reservoir 216 is inserted into the chamber 218 during assembly, as described below. The insertion aperture 226 is located at an in use lower portion of the chamber 218, at an upstream end of the chamber 218. The chamber 218 comprises a chamber plug 228 which seals the insertion aperture 226. The chamber plug 228 provides an upstream wall of the chamber 218. The chamber plug 228 is formed of a silicone material.

The reservoir 216 is in a substantially uncompressed state in the chamber 218. In other examples, the reservoir 216 in its substantially uncompressed state is wider than the insertion aperture 226.

The flavour pod portion 202 comprises a member 220, which comprises an aerosol generator portion 222 and a supporting portion 223. The aerosol generator portion 222 is located at a downstream end (an upper end in FIG. 6) of the member 220, while the supporting portion 223 makes up the rest of the member 220. The supporting portion 223 is elongate and substantially cylindrical. The aerosol generator portion 222 is bulb-shaped, and comprises a portion which is wider than the supporting portion 223. The aerosol generator portion 222 tapers to a tip at a downstream end of the aerosol generator portion 222.

The member 220 extends into and through the storage 214. The supporting portion 223 extends into the storage 214 by at least 50% of the length of the storage 214. More specifically, the supporting portion 223 extends into the storage 214 by at least 60% of the length of the storage 214. More specifically, the supporting portion 223 extends into the storage 214 by at least 70% of the length of the storage 214. More specifically, the supporting portion 223 extends into the storage 214 by at least 80% of the length of the storage 214. More specifically, the supporting portion 223 extends into the storage 214 by at least 90% of the length of the storage 104. More specifically, the supporting portion 223 extends all of the way into the storage 214, to the bottom of the storage as shown in FIG. 6. More specifically, the supporting portion 223 extends beyond the storage, and is received in a recess of the chamber 218. The member 220 is in contact with the reservoir 216. More specifically, the supporting portion 223 extends into and through the storage 204 and is in contact with the reservoir 216. The member 220 is located in a substantially central position within the reservoir 216 and is substantially parallel to a central axis of the consumable. The member 220 is formed of a second porous material. The second porous material is porous polyester fibre with polyurethane resin.

The second porous material has at least 30% porosity. More specifically, the second porous material has at least 40% porosity. More specifically, the second porous material has at least 50% porosity.

The second porous material has at most 90% porosity. More specifically, the second porous material has at most 80% porosity. More specifically, the second porous material has at most 70% porosity. More specifically, the second porous material has substantially 60% porosity.

The first and second airflow branches 210, 212 are located on opposite sides of the member 220. Additionally, the first and second airflow branches 210, 212 are located on opposite sides of the reservoir 216. The first and second airflow branches 210, 212 branch in a radial outward direction (with respect to the central axis of the consumable 200) downstream of the inlet 204 to reach the opposite sides of the reservoir 216.

The aerosol generator portion 222 is located in the airflow passage 208 downstream of the first and second airflow branches 210, 212. The first and second airflow branches 210, 212 turn in a radially inward direction to merge at the member 220, at a point upstream of the aerosol generator portion 222.

The aerosol generator portion 222 is located in a narrowing section 224 of the airflow passage 208. The narrowing section 224 is downstream of the point at which the first and second airflow branches 210, 212 merge, but upstream of the mouthpiece aperture 207. The mouthpiece aperture 207 flares outwardly in the downstream direction, such that a width of the mouthpiece aperture 207 increases in the downstream direction.

Referring to FIG. 7*a*, the air flow passage 208 has a cross-sectional area of at most 2.0 $mm^2$ at the aerosol generator portion (i.e. at the narrowing section 224, as indicated in FIG. 7*a*, and excluding the support described below with respect to FIG. 7*c*). This is the area of the annular portion at which the aerosol generator portion is positioned, downstream of the point at which the first and second airflow branches 210, 212 merge. More specifically, the air flow passage 208 has a cross-sectional area of at most 1.8 $mm^2$ at the aerosol generator portion. More specifically, the air flow passage 208 has a cross-sectional area of at most 1.6 $mm^2$ at the aerosol generator portion. More specifically, the air flow passage 208 has a cross-sectional area of at most 1.4 $mm^2$ at the aerosol generator portion. More specifically, the air flow passage 208 has a cross-sectional area of at most 1.2 $mm^2$ at the aerosol generator portion.

The air flow passage 208 has a cross-sectional area of at least 0.2 $mm^2$ at the aerosol generator portion (again at the narrowing section 224, as indicated in FIG. 7*a*). More specifically, the air flow passage 208 has a cross-sectional area of at least 0.4 $mm^2$ at the aerosol generator portion. More specifically, the air flow passage 208 has a cross-sectional area of at least 0.6 $mm^2$ at the aerosol generator portion. More specifically, the air flow passage 208 has a cross-sectional area of at least 0.8 $mm^2$ at the aerosol generator portion. More specifically, the air flow passage 208 has a cross-sectional area of substantially 1.0 $mm^2$ at the aerosol generator portion.

In this example, the areas of the air flow passage 208 described here relate to the narrowest area through which air flows past the aerosol generator portion. However, since there is little variation in the width of the aerosol generator portion 222 in the narrowing section 224, this area is substantially constant throughout the narrowing section 224.

Referring to FIG. 7*b*, the aerosol generator portion 222 has an atomising area 226 of more than 10 $mm^2$.

The atomising area may be defined as the surface area of the portion from which substantial first aerosol is generated, which in this example is the surface area of the part of the aerosol generator portion which is located in the narrowing section 224. The atomising area may be defined as the surface area from which 95% of the first aerosol is generated.

More specifically, the atomising area 226 is at least 16 $mm^2$. More specifically, the atomising area 226 is at least 18 $mm^2$. More specifically, the atomising area 226 is at least 20 $mm^2$. More specifically, the atomising area 226 is at least 20 $mm^2$.

The atomising area 226 is not more than 36 $mm^2$. More specifically, the atomising area 226 is not more than 30 $mm^2$. More specifically, the atomising area 226 is not more than 28 $mm^2$. More specifically, the atomising area 226 is not more than 26 $mm^2$. More specifically, the atomising area 226 is not more than 24 $mm^2$.

More specifically, the atomising area 226 is substantially 22 $mm^2$.

Figure 7C:
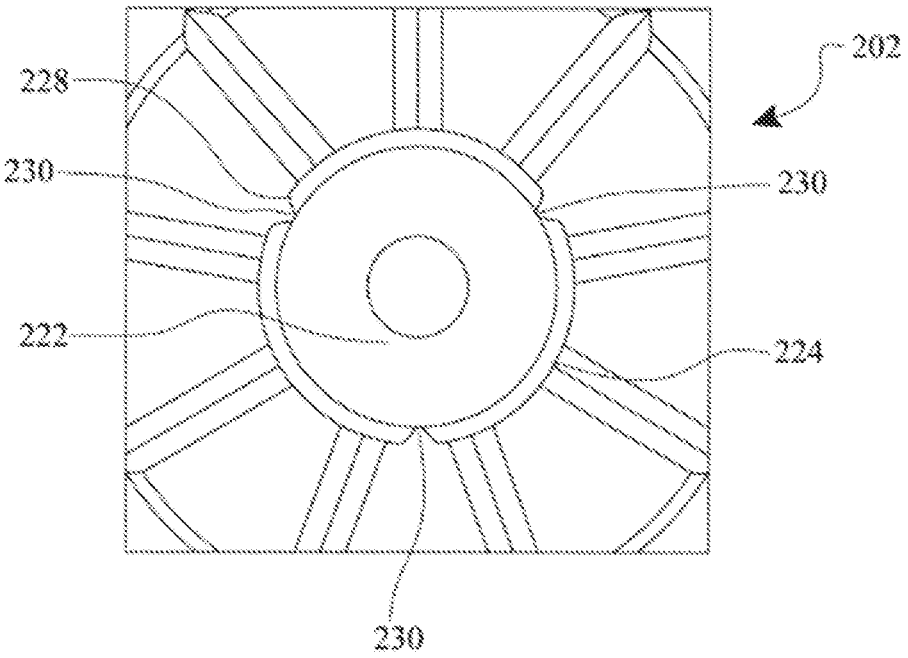
FIG. 7*c* shows a top view of a part of a flavour pod portion of a consumable.

Referring to FIG. 7*c*, the flavour pod portion 202 further comprises a support 228. The support 228 comprises ribs 230 extending inwardly from the narrowing section 224. The support 228 comprises three ribs 230 extending inwardly from the narrowing section 224 of the air flow passage 208. The ribs 230 are substantially equi-spaced around the narrowing section 224. Apart from the support 228, the narrowing section 224 has a generally annular shape.

The ribs 230 contact the aerosol generator portion 222. The ribs 230 pierce an outer surface of the aerosol generator portion 222 to thereby grip the aerosol generator portion 222.

In use, when a user draws on the mouthpiece 209, air flow is generated through the air flow passage 208. Air (comprising the second aerosol from the cartomiser portion as explained above with respect to FIG. 5) flows through the inlet 206 before the air flow splits to flow through the first and second airflow branches 210, 212. Further downstream, the first and second airflow branches 210, 212 provide inward airflow towards the member 220 and the aerosol generator portion 222.

As air flows past the aerosol generator portion in the narrowing section 224, the velocity of the air increases, resulting in a drop in air pressure. This means that the air picks up the first aerosol precursor from the aerosol generator portion 222 to form the first aerosol. The first aerosol has the particle size and other properties described above with respect to FIG. 5.

The air picks up more than 1.0 mg total particle mass (TPM) of first aerosol per delivery event. More specifically, the air picks up more than 1.5 mg TPM of first aerosol per delivery event. More specifically, the air picks up more than 2.0 mg TPM of first aerosol per delivery event. More specifically, the air picks up more than 2.5 mg TPM of first aerosol per delivery event. More specifically, the air picks up more than 3.0 mg TPM of first aerosol per delivery event.

The air picks up less than 20.0 mg TPM of first aerosol per delivery event. More specifically, the air picks up less than 13.0 mg TPM of first aerosol per delivery event. More specifically, the air picks up less than 8.0 mg TPM of first aerosol per delivery event. More specifically, the air picks up less than 6.0 mg TPM of first aerosol per delivery event. More specifically, the air picks up less than 4.0 mg TPM of first aerosol per delivery event.

First aerosol of the TPM values described above may be picked up when the aerosol generator portion 223 is saturated, which may be when the storage 214 is full. A delivery event may refer to a typical single draw on the mouthpiece 209 by a user.

In a delivery event, the user may inhale on the mouthpiece 209 such that a flow rate of between 1.0 and 4.0 litres/minute is effected in the airflow passage 208. The user may inhale on the mouthpiece 209 such that a flow rate of substantially 2.5 litres/minute is effected in the airflow passage 208. Such a flow rate may result in a velocity of substantially 40 m/s in the narrowing section 224.

The delivery event may have a duration (i.e. the period for which the user inhales on the mouthpiece 209) of between 1.0 and 4.0 seconds. The delivery event may have a duration of between 1.5 and 2.5 seconds, and in some examples substantially 2.0 seconds.

As the first aerosol precursor is picked up by the air, the member 220 transfers further first aerosol precursor from the storage 214 to the aerosol generator portion 222. More specifically, the member 220 wicks the first aerosol precursor from the storage 214 to the aerosol generator portion 223.

In other examples, the storage 214 comprises a tank containing the first aerosol precursor as free liquid, rather than the reservoir 216 and the chamber 218. In such examples, the member 220 still extends into the tank to transfer first aerosol precursor from the tank to the aerosol generator portion 223.

The support 228 maintains the aerosol generator portion 222 in a substantially central position in the narrowing section 224.

In other examples, the storage 214 comprises a tank containing the first aerosol precursor as free liquid, rather than the reservoir 216 and the chamber 218. In such examples, the member 220 still extends into the tank to transfer first aerosol precursor from the tank to the aerosol generator portion 223.

FIGS. 7*a* and 7*b* show further views of the flavour pod portion 202 which highlight features of the mouthpiece 209. Many of the reference numerals of FIG. 6 are omitted from FIGS. 7*a* and 7*b* for clarity.

The mouthpiece aperture 206 comprises an inner surface 226, which is uneven. In the present example, the inner surface 226 has the form of a substantially frustoconical surface, but includes grooves or channels 228 to make the inner surface 226 somewhat uneven. In other examples, the inner surface 226 may have another form (for example, the form a substantially cylindrical surface), and may include any type of protrusion or groove to make the inner surface uneven.

The inner surface 226 is angled with respect to the axial direction (i.e. relative to a central axis of the consumable) such that the width of the mouthpiece aperture 209 increases in the downstream direction. The inner surface 226 is immediately downstream of the narrowing section 224 of the airflow passage 108.

The grooves 228 are generally v-shaped in cross-sectional profile, and extend in the axial direction for the full length of the inner surface 226. Each groove 228 is formed from a pair of surfaces angled at between 30 and 90 degrees relative to each other. More specifically, each groove 228 is formed from a pair of surfaces angled at 60 degrees relative to each other.

The grooves 228 have a depth (measured normal to the inner surface 226) of at least 0.2 mm. More specifically, the grooves 228 have a depth of at least 0.3 mm. More specifically, the grooves 228 have a depth of at least 0.4 mm.

The grooves 228 have a depth of less than 0.8 mm. More specifically, the grooves have a depth of less than 0.7 mm. More specifically, the grooves have a depth of less than 0.6 mm. More specifically, the grooves have a depth of substantially 0.5 mm.

The grooves 228 are substantially equi-spaced in a circumferential manner around the inner surface 226.

The inner surface 226 comprises at least 6 grooves. More specifically, the inner surface comprises at least 7 grooves. More specifically, the inner surface 226 comprises at least 8 grooves.

The inner surface 226 comprises at most 12 grooves 228. More specifically, the inner surface 226 comprises at most 11 grooves 228. More specifically, the inner surface 226 comprises at most 10 grooves 228. More specifically, the inner surface 226 comprises 9 grooves 228.

The grooves 228 are spaced apart from each other by substantially 1 mm at the downstream end of the inner surface 226. In other examples, the spacing at the downstream end of grooves or protrusions may be selected such that it is equal to or less than the mass median diameter (as described above) of particles in the first aerosol.

The inner surface 226 comprises a smooth polished surface between the grooves 228. Polishing the surface in this way provides improved aerodynamic properties. However, in other examples, the inner surface 226 may be textured. In such examples, the texture of the surface may provide the uneven surface, and no grooves are required, In use, the uneven nature of the inner surface 226 makes it easier for droplets to form on the inner surface 226, preventing large droplets from entering the user's mouth. The grooves 228 help to channel the large droplets back into the consumable.

Figure 8:
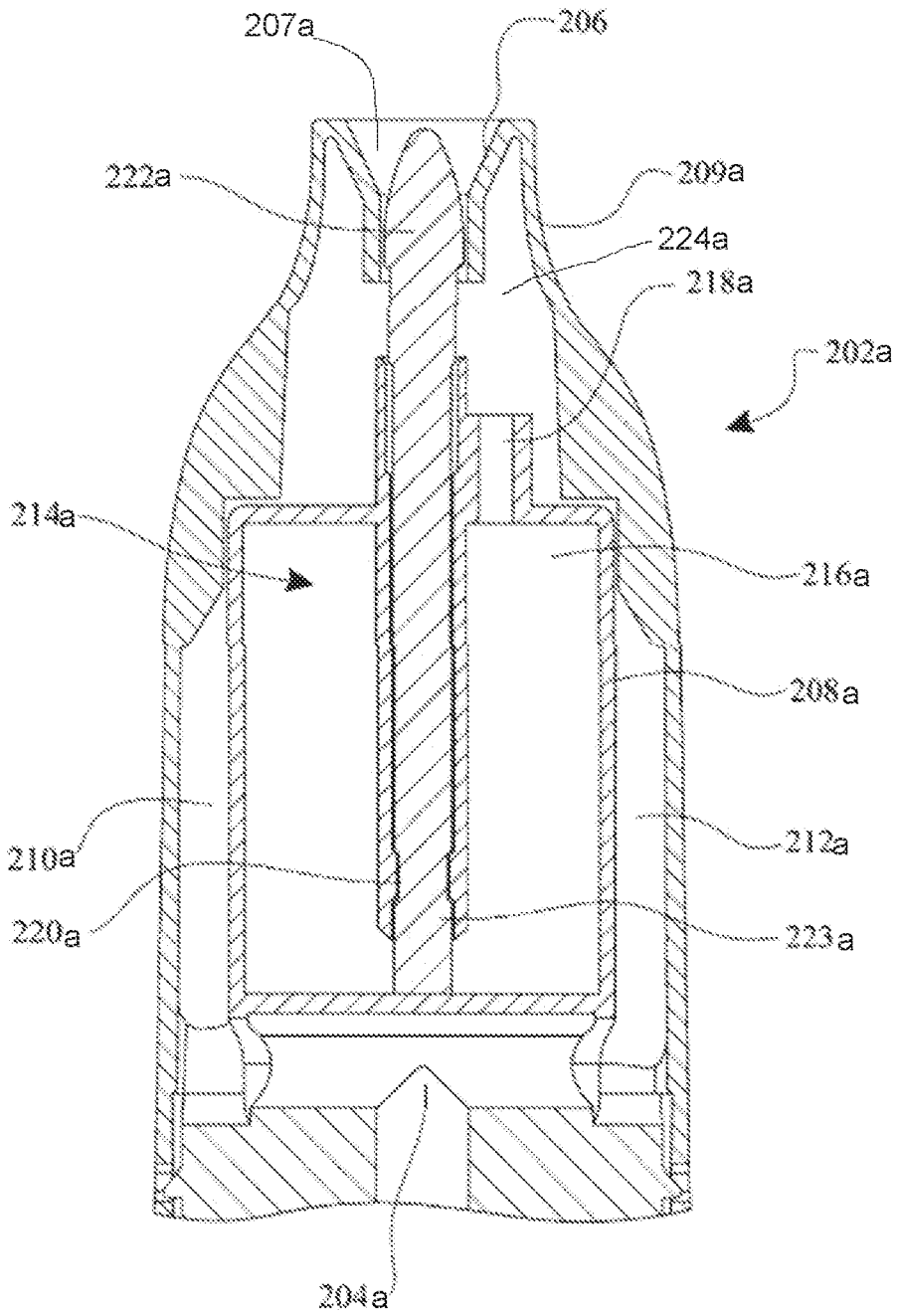
FIG. 8 shows a cross-sectional view of another embodiment of a flavour pod portion of a consumable constructed in accordance with the present disclosure.

Shown in FIG. 8 is another example of a flavour pod portion 202*a* constructed in accordance with the present disclosure that is similar in construction and function as the flavour pod portion 202 described above with respect to FIG.

6. For purposes of clarity, only the differences between the flavour pod portion 202*a* of FIG. 8 and the flavour pod portion 202 of FIG. 6 will be described hereinafter.

Shown in FIG. 8 is the flavour pod portion 202*a* comprising a storage 214*a*, which stores a first aerosol precursor. The storage 214*a* comprises a tank 216*a* storing the first aerosol precursor as a free liquid. The tank 216*a* comprises a tank aperture 218*a* providing fluid communication between the tank 216*a* and an exterior of the tank 216*a*. More specifically, the tank aperture 218*a* provides fluid communication between the tank 216*a* and an airflow passage 208*a*. Yet more specifically, the tank aperture 218*a* provides fluid communication between the tank 216*a* and a second airflow branch 212*a*.

The tank aperture 218*a* is configured to permit air flow into the tank 216*a* as the tank 216*a* empties of first liquid. The tank aperture 218*a* is configured to inhibit flow of first aerosol precursor out of the tank 216*a*. In this example, this is achieved by the flavour pod portion 202*a* comprising a non-return valve (not shown) located in the tank aperture 218*a*. The non-return valve may take any one of various forms (for example, a simple mechanical valve), and in some embodiments is a duckbill valve. The valve is opened by a pressure drop in the airflow passage 208*a* caused by the user drawing on the mouthpiece 209*a*.

The flavour pod portion 202*a* comprises a member 220*a*, which comprises an aerosol generator portion 222*a* and a supporting portion 223*a*. The aerosol generator portion 222*a* is located at a downstream end (an upper end in FIG. 8) of the member 220*a*, while the supporting portion 223*a* makes up the rest of the member 220*a*. The supporting portion 223*a* is elongate and substantially cylindrical. The aerosol generator portion 222*a* is bulb-shaped, and comprises a portion which is wider than the supporting portion 223*a*. The aerosol generator portion 222*a* tapers to a tip at a downstream end of the aerosol generator portion 222*a*.

The member 220*a* extends into and through the storage 214*a*. The member 220*a* is in contact with the reservoir 216*a*. More specifically, the supporting portion 223*a* extends into and through the storage 204*a* and is in contact with the first aerosol precursor in the tank 216*a*. The member 220*a* is located in a substantially central position within the tank 216*a* and is substantially parallel to a central axis of the consumable. The member 220*a* is formed of a second porous material.

The first and second airflow branches 210*a*, 212*a* are located on opposite sides of the member 220*a*. Additionally, the first and second airflow branches 210*a*, 212*a* are located on opposite sides of the reservoir 216*a*. The first and second airflow branches 210*a*, 212*a* branch in a radial outward direction (with respect to the central axis of the consumable 200*a*) downstream of the inlet 204*a* to reach the opposite sides of the reservoir 216*a*.

The aerosol generator portion 222*a* is located in the airflow passage 208*a* downstream of the first and second airflow branches 210*a*, 212*a*. The first and second airflow branches 210*a*, 212*a* turn in a radially inward direction to merge at the member 220*a*, at a point upstream of the aerosol generator portion 222*a*.

The aerosol generator portion 222*a* is located in a narrowing section 224*a* of the airflow passage 208*a*. The narrowing section 224*a* is downstream of the point at which the first and second airflow branches 210*a*, 212*a* merge, but upstream of the mouthpiece aperture 207*a*. The mouthpiece aperture 207*a* flares outwardly in the downstream direction, such that a width of the mouthpiece aperture 207*a* increases in the downstream direction.

In use, when a user draws on the mouthpiece 209*a*, air flow is generated through the air flow passage 208*a*. Air (comprising the second aerosol from the cartomiser portion as explained above with respect to FIG. 5) flows through the inlet 204*a* before the air flow splits to flow through the first and second airflow branches 210*a*, 212*a*. Further downstream, the first and second airflow branches 210*a*, 212*a* provide inward airflow towards the member 220*a* and the aerosol generator portion 222*a*.

As air flows past the aerosol generator portion in the narrowing section 224*a*, the velocity of the air increases, resulting in a drop in air pressure. This means that the air picks up the first aerosol precursor from the aerosol generator portion 222*a* to form the first aerosol. The first aerosol has the particle size and other properties described above with respect to FIG. 5.

As the first aerosol precursor is picked up by the air, the member 220*a* transfers further first aerosol precursor from the storage 214*a* to the aerosol generator portion 222*a*. More specifically, the member 220*a* wicks the first aerosol precursor from the storage 214*a* to the aerosol generator portion 223*a*.

In other examples, the flavour pod portion 202*a* comprises a plug located in the tank aperture 218*a*, the plug formed of a matrix material permitting air flow but preventing flow of first aerosol precursor therethrough. This is achieved by the plug becoming saturated with first aerosol precursor, with the first aerosol precursor held in the plug by surface tension of the liquid. Air flow through the saturated plug is still possible through the plug.

This means that in use, as the pressure in the tank 216*a* drops due to wicking of the first aerosol precursor by the member 222*a*, air flows into the tank 216*a* to equalise the pressure. This is desirable as low pressure in the tank 216*a* would resist flow of first aerosol precursor out of the tank 216*a*. The matrix material may be a fibrous material (for example cotton or a mono acetate fibre) or may be made from a material such as polyetherimide (PEI).

Figure 9:
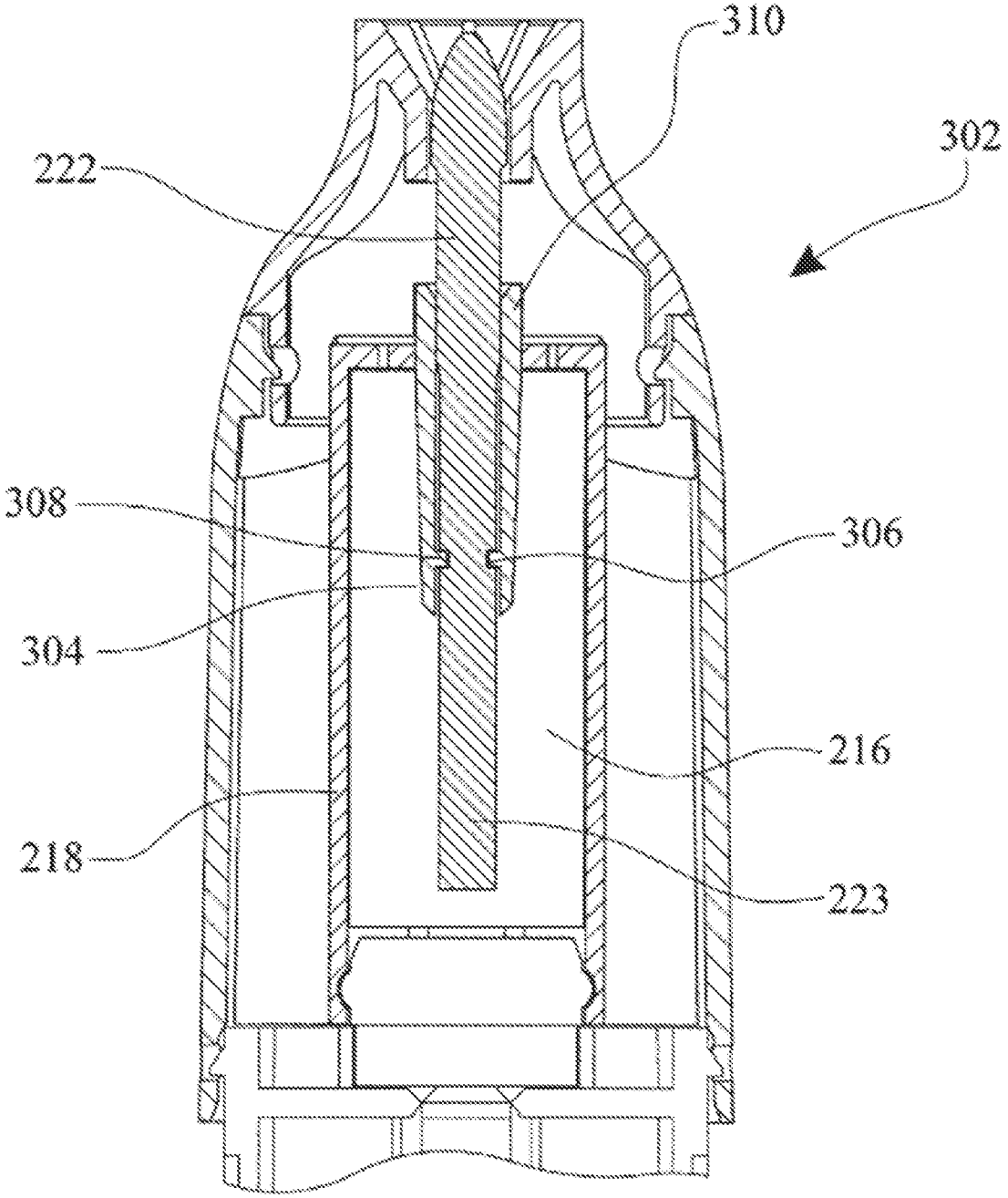
FIG. 9 shows a cross-sectional view of a flavour pod portion of a second consumable.

Referring to FIG. 9, there is shown an alternative flavour pod portion 302 of a consumable, again providing an aerosol delivery device. The flavour pod portion 302 illustrated in FIG. 9 comprises all of the features of the flavour pod portion 202 described above with respect to FIG. 6, along with the additional features described here. For clarity many reference numerals are omitted from FIG. 9.

The second flavour pod portion 302 comprises mutually engaging features 304. The mutually engaging features 304 comprise a groove 306 and a protrusion 308.

The second flavour pod portion 302 comprises a tube 310. The tube 310 extends through an upper wall of the chamber 218. The tube 310 is formed as part of the chamber 218. The tube 310 is substantially concentric with the second flavour pod portion 302.

The protrusion 308 extends inwardly from an inner surface of the tube 310. The protrusion 308 extends all of the way around the inner surface of the tube 310. The protrusion 308 has a substantially annular shape.

The groove 306 is formed in the aerosol generator portion 222 of the member 220. More specifically, the groove 306 is formed in an exterior surface of the supporting portion 223 of the member 222. The groove 306 extends all of the way around the member 222. The groove 306 has a substantially annular shape. The groove's shape substantially matches the protrusion's shape 308. The member 222 is received in the tube 310. The tube 310 has an internal diameter substantially equal to an external diameter of the member 222. The tube 310 is surrounded by the reservoir 216. The tube 310 does not extend fully into the reservoir 216, and the member 222 extends beyond the tube 310 to contact the reservoir 216.

The protrusion 308 is received in the groove 306. More specifically, the groove 306 and the protrusion 308 interlock with each other to maintain the member 222 in the second flavour pod portion 302.

The groove 306 is formed in the second porous material of the member 222 by grinding the member 222.

Figure 10:
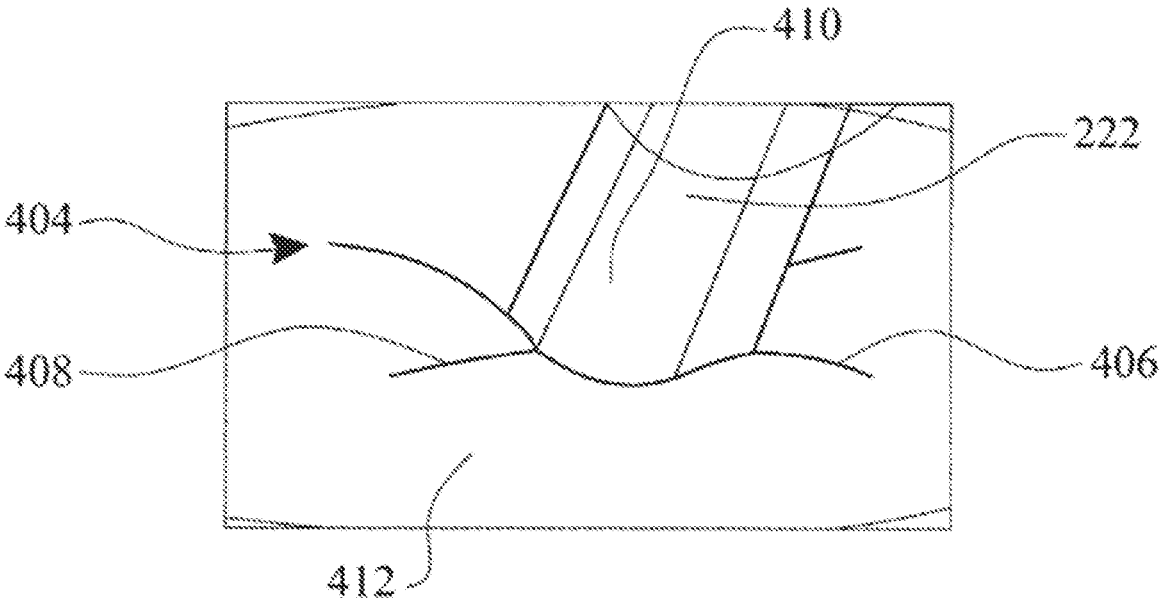
FIG. 10 shows a perspective view of mutually engaging features.
Figure 11A:
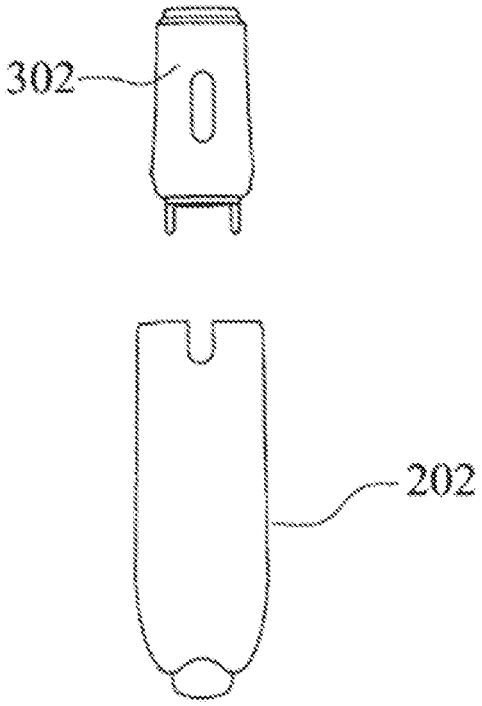
FIGS. 11*a*-11*d* show view of an assembly apparatus.
Figure 11B:
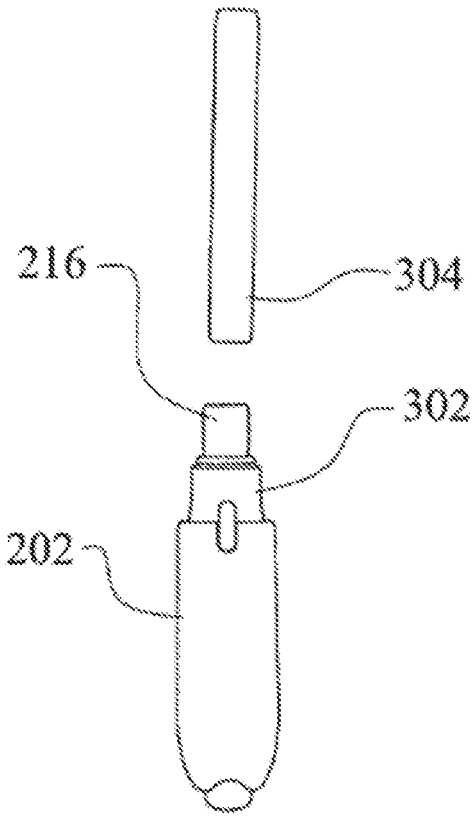
Figure 11C:
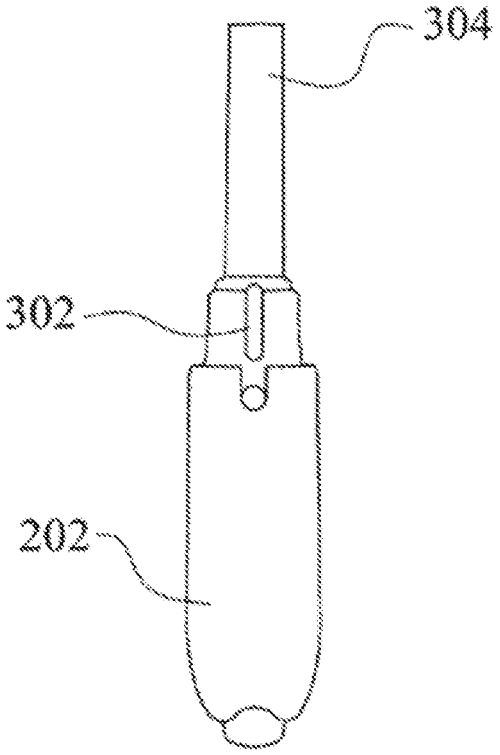
Figure 11D:
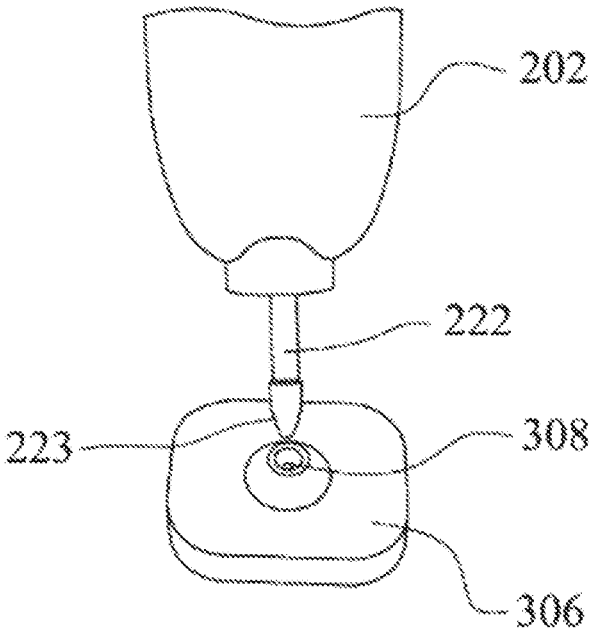

Referring to FIG. 10, there are shown second mutually engaging features 404, which may be used in a flavour pod portion as described above. The second mutually engaging features 404 comprise barbs 408 and a deformable surface 410. The deformable surface 410 is the exterior surface of the member 222.

The barbs 408 are provided in the edges of a slit 406. The slit 406 is substantially cross-shaped. The slit 406 is formed in a flexible sheet 412, which is fixed to the flavour pod portion. The flexible sheet 412 is formed of a polymeric material. In some examples (e.g. where the flexible sheet is thin), the barbs 408 are formed by edges of the slit 406.

When the member 220 is inserted into the flavour pod portion, the member 220 passes through the slit 406. The flexible sheet 412 deform at the slit 406 in the direction of insertion of the member 220, permitting the member 222 to pass through the slit 406.

Once the member 220 has been inserted into the slit 406, the flexible sheet 412 remains deformed in the direction of insertion of the member 222. This means that if a force is applied to the member 220 in a direction opposite to the direction of insertion of the member 220, the barbs 408 become urged inwardly towards the member 220 so as to penetrate the deformable surface 410 and thereby engage with the deformable surface 410. More specifically, the barbs 408 penetrate the deformable surface 410 to interlock with the deformable surface 410. This resists removal of the member 220 from the slit 406 and maintains the member 220 in the flavour pod portion.

In other examples, the aerosol delivery device comprises other types of mutually engaging features to maintain the member in the aerosol delivery device. Mutually engaging features may be defined as any features which interlock with each other to maintain the member in the aerosol delivery device.

Referring to FIG. 11*a* to FIG. 11*d*, there is shown an assembly apparatus 300 for the flavour pod portion 202. The assembly apparatus 300 comprises a sleeve 302, a pushing tool 304 and a locating tool 306.

The sleeve 302 has an internal width which is less than the width of the reservoir 216 in the substantially uncompressed state. The sleeve 302 has an external width which is less than the width of the insertion aperture 226. The sleeve 302 is open at both ends. The tool 304 has an external width which is less than the internal width of the sleeve 302.

The locating tool 306 takes the form of a plate having a generally planar under-surface so that it may be securely located on a work surface. The locating tool 306 furthermore comprises a recess 308 for receiving the aerosol generator portion 223 of the member 222.

To assemble the flavour pod portion 202, the reservoir 216 is inserted into the sleeve 302, as illustrated in FIG. 7*b*. As will be appreciated, the reservoir 216 must be compressed in order to be inserted into the sleeve 302, and will thus adopt a compressed state inside the sleeve 302.

A first end of the sleeve 302 is then inserted into the chamber 218 through the insertion aperture 226. The reservoir 216 is then pushed out of the sleeve 302 and into the chamber 218. More specifically, the reservoir 216 is pushed out of the sleeve 302 using the pushing tool 304, by inserting the pushing tool 304 into a second end of the sleeve 302 and pressing against the reservoir 216 so as to urge it out of the sleeve

302. As the reservoir is pushed out of the sleeve 302 in this manner, it will return to its original uncompressed state due to its inherent resilience, such that when the reservoir 216 is fully clear of the sleeve 302, and located inside the chamber 218, it will adopt a substantially uncompressed relaxed state.

Once the reservoir 216 has been fully pushed out of the sleeve 302 and into the chamber 218, the member 222 is pushed into the flavour pod portion 202 through the mouthpiece aperture 209. The member 222 comprises a tapered end (at the opposite end to the aerosol generator portion 223), which helps the member 222 to pierce the reservoir 216 during insertion of the member 222.

To insert the member 222, the member 222 is partially pushed into the mouthpiece aperture 209, before the flavour pod portion 202 is pushed towards the locating tool 306 while the aerosol generator portion 223 is received in the recess 308 of the locating tool 306. The recess prevents lateral movement of the aerosol generator portion 223 during insertion of the member 222. As will be noted, the recess 308 actually has a frustonical inner surface which at least approximately corresponds to the outer surface of the aerosol generator portion 223. This helps to distribute forces across the tip of the aerosol generator portion during the process of pushing the member 222 into the flavour pod portion 202, thereby ensuring that the tip of the aerosol generator portion 223 is not damaged during the process.

The chamber plug 228 is then inserted into the insertion aperture 226 before the cartomiser portion is connected to the flavour pod portion.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the disclosure has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the words "have", "comprise", and "include", and variations such as "having", "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the"

include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means, for example, +/−10%.

The words "preferred" and "preferably" are used herein refer to embodiments of the invention that may provide certain benefits under some circumstances. It is to be appreciated, however, that other embodiments may also be preferred under the same or different circumstances. The recitation of one or more preferred embodiments therefore does not mean or imply that other embodiments are not useful, and is not intended to exclude other embodiments from the scope of the disclosure, or from the scope of the claims.

The invention claimed is:

1. An aerosol delivery device comprising:

an aerosol generator portion configured to receive a first aerosol precursor;

an air flow passage configured to direct air past an outer surface of the aerosol generator portion to pick up the first aerosol precursor from the aerosol generator portion to form a first aerosol;

a support for maintaining the aerosol generator portion in a substantially central position in the air flow passage; and wherein the aerosol generator portion is a passive aerosol generator portion.

2. The aerosol delivery device according to claim 1, and further comprising a mouthpiece, the mouthpiece comprising a mouthpiece aperture forming part of the air flow passage, wherein the support is located in the mouthpiece aperture.

3. The aerosol delivery device according to claim 2, wherein the support comprises ribs extending inwardly from a narrowing section of the air flow passage.

4. The aerosol delivery device according to claim 3, wherein the support comprises three ribs extending inwardly from the narrowing section air flow passage.

5. The aerosol delivery device according to claim 1, and further comprising a member, the member comprising the aerosol generator portion, wherein the member is configured to transfer the first aerosol precursor to the aerosol generator portion.

6. The aerosol delivery device according to claim 5, wherein the member is formed of a porous material, the member configured to wick the first aerosol precursor to the aerosol generator portion.

7. The aerosol delivery device according to claim 1, and further comprising a storage for storing the first aerosol precursor.

8. The aerosol delivery device according to claim 7, wherein the storage comprises a reservoir, the reservoir formed of a porous material.

9. The aerosol delivery device according to claim 7, wherein the storage comprises a tank configured to store the first aerosol precursor as a free liquid.

10. The aerosol delivery device according to claim 1, wherein the first aerosol is sized to inhibit pulmonary penetration, and the first aerosol is transmissible within at least one of a mammalian oral cavity and a mammalian nasal cavity.

11. The aerosol delivery device according to claim 1, wherein the aerosol delivery device is a consumable for a smoking substitute device.

12. The aerosol delivery device according to claim 1, and further comprising a second aerosol generator, the second aerosol generator configured to produce a second aerosol from a second aerosol precursor, wherein the second aerosol is sized for pulmonary penetration.

13. The aerosol delivery device according to claim 12, wherein the second aerosol generator is configured to heat the second aerosol precursor to form the second aerosol.

14. The aerosol delivery device according to claim 12, wherein the second aerosol generator is located so as to be upstream of the first aerosol generator in use.

15. A method of making an aerosol delivery device comprising:

configuring an aerosol generator portion to receive a first aerosol precursor;

configuring an air flow passage to direct air past an outer surface of the aerosol generator portion to pick up the first aerosol precursor from the aerosol generator portion to form a first aerosol;

maintaining the aerosol generator portion in a substantially central position in the air flow passage; and wherein the aerosol generator portion is a passive aerosol generator portion.

16. The method of claim 15, and wherein the step of maintaining the aerosol generator portion in a substantially central position in the air flow passage includes providing a mouthpiece comprising a mouthpiece aperture forming part of the air flow passage, and supporting the aerosol generator portion within the mouthpiece aperture.

17. The method of claim 16, wherein the step of providing the mouthpiece is defined further as supporting the aerosol generator portion within the mouthpiece aperture with ribs extending inwardly from a narrowing section of the air flow passage.

18. The method of claim 17, wherein the step of providing the mouthpiece is defined further as supporting the aerosol generator portion within the mouthpiece aperture with three ribs extending inwardly from a narrowing section of the air flow passage.

19. The method of claim 15, and further comprising transferring the first aerosol precursor to the aerosol generator portion.

20. The method of claim 19, wherein transferring the first aerosol precursor to the aerosol generator portion includes wicking the first aerosol precursor to the aerosol generator portion.

* * * * *